US009296171B2

(12) United States Patent
Bierschenk et al.

(10) Patent No.: US 9,296,171 B2
(45) Date of Patent: Mar. 29, 2016

(54) METHOD FOR MAKING A FLAT BOTTOM PILLOW POUCH

(75) Inventors: Patrick Joseph Bierschenk, Dallas, TX (US); Martin Bernhard Dierl, Allen, TX (US); Chad Arthur Huebner, Hurst, TX (US); Jerry Mike Reaves, Midlothian, TX (US)

(73) Assignee: FRITO-LAY NORTH AMERICA, INC., Plano, TX (US)

( * ) Notice: Subject to any disclaimer, the term of this patent is extended or adjusted under 35 U.S.C. 154(b) by 2404 days.

(21) Appl. No.: 12/046,170

(22) Filed: Mar. 11, 2008

(65) Prior Publication Data

US 2009/0232424 A1 Sep. 17, 2009

(51) Int. Cl.

| | |
|---|---|
| ***B65B 9/10*** | (2006.01) |
| ***B65B 9/20*** | (2012.01) |
| ***B31B 19/36*** | (2006.01) |
| ***B31B 37/00*** | (2006.01) |
| ***B65B 9/213*** | (2012.01) |
| ***B65B 41/16*** | (2006.01) |
| ***B65B 51/14*** | (2006.01) |
| ***B65B 51/30*** | (2006.01) |
| ***B65D 75/00*** | (2006.01) |
| ***B65D 75/48*** | (2006.01) |

(52) U.S. Cl.

CPC ..... *B31B 19/36* (2013.01); *B31B 37/00* (2013.01); *B65B 9/2028* (2013.01); *B65B 9/2049* (2013.01); *B65B 9/213* (2013.01); *B65B 41/16* (2013.01); *B65B 51/146* (2013.01); *B65B 51/303* (2013.01); *B65D 75/008* (2013.01); *B65D 75/48* (2013.01); *B31B 2219/2627* (2013.01); *B31B 2237/20* (2013.01); *B65B 9/2056* (2013.01)

(58) Field of Classification Search

CPC ..... B65B 9/10; B65B 9/20; B65D 75/008
USPC ..... 53/450, 451, 550, 551, 375.5, 375.6, 53/375.7, 479, 374.7, 375.2; 383/104, 124
See application file for complete search history.

(56) References Cited

U.S. PATENT DOCUMENTS

| | | | | |
|---|---|---|---|---|
| 2,154,521 | A * | 4/1939 | Maxfield | 53/449 |
| 3,326,097 | A * | 6/1967 | Lokey | 493/295 |
| 3,552,087 | A * | 1/1971 | Schneider et al. | 3/451 |
| 3,774,509 | A * | 11/1973 | Heinzer | B31B 7/00 493/235 |

(Continued)

FOREIGN PATENT DOCUMENTS

| | | |
|---|---|---|
| EP | 1283179 A1 | 2/2003 |
| GB | 2141395 | 5/1984 |

(Continued)

OTHER PUBLICATIONS

Microwavable Aseptic Sauces Unveiled in Chicago, Tatra Pak Canada web site, http://www.tetrapak.ca/newsItem.asp?NewsID=129 (Dec. 12, 2005).

*Primary Examiner* — Stephen F Gerrity
(74) *Attorney, Agent, or Firm* — Colin P. Cahoon; Stephen Y. Liu; Carstens & Cahoon, LLP

(57) ABSTRACT

The present invention discloses a flat bottom pillow pouch that can stand upright on its bottom transverse seal. The flat bottom pillow bag can be made from the same film as a standard pillow pouch and requires less film than prior art stand up packages. The flat bottom pillow pouch disclosed herein has no gussets.

15 Claims, 20 Drawing Sheets

(56) References Cited

U.S. PATENT DOCUMENTS

| | | | | |
|---|---|---|---|---|
| 3,785,112 | A | 1/1974 | Leasure et al. | |
| 3,812,644 | A * | 5/1974 | Kamikawa et al. | 53/459 |
| 3,973,474 | A * | 8/1976 | Auckenthaler | B65B 9/2014 493/197 |
| 4,079,662 | A * | 3/1978 | Puccetti et al. | 53/552 |
| 4,230,030 | A * | 10/1980 | Hanson et al. | B31B 1/00 493/194 |
| 4,562,691 | A * | 1/1986 | Rapparini | B65B 9/20 53/552 |
| 4,746,391 | A | 5/1988 | Heyse et al. | |
| 4,870,804 | A * | 10/1989 | Yokoyama | 53/450 |
| 4,892,511 | A * | 1/1990 | Luciano et al. | B31B 29/00 493/194 |
| 4,924,658 | A * | 5/1990 | Takehama | 53/547 |
| 4,929,224 | A * | 5/1990 | Hanson et al. | B31B 29/00 493/194 |
| 5,249,408 | A * | 10/1993 | Winnemoller et al. | 53/439 |
| 5,398,486 | A | 3/1995 | Kauss et al. | |
| 5,505,040 | A | 4/1996 | Janssen et al. | |
| 5,508,075 | A | 4/1996 | Roulin et al. | |
| 5,570,569 | A * | 11/1996 | Masuda | 53/410 |
| 5,732,532 | A * | 3/1998 | Fujisaki et al. | 53/451 |
| 5,862,652 | A | 1/1999 | Schoeler | |
| 6,539,688 | B2 * | 4/2003 | Fahs et al. | 53/412 |
| 6,543,205 | B1 | 4/2003 | Faskhoody et al. | |
| 6,694,705 | B1 | 2/2004 | Frei et al. | |
| 6,695,757 | B2 | 2/2004 | Edwards et al. | |
| 6,718,739 | B2 | 4/2004 | Kohl et al. | |
| 6,722,106 | B2 | 4/2004 | Bartel et al. | |
| 7,122,234 | B2 * | 10/2006 | Olofsson et al. | 428/36.91 |
| 7,189,300 | B2 | 3/2007 | Knoerzer | |
| 7,197,859 | B2 | 4/2007 | Knoerzer et al. | |
| 7,299,608 | B2 * | 11/2007 | Kohl et al. | B65B 9/20 53/451 |
| 7,458,195 | B2 | 12/2008 | Bezek et al. | |
| 7,681,377 | B2 | 3/2010 | Simmons et al. | |
| 7,908,826 | B2 | 3/2011 | Reaves et al. | |
| 7,963,697 | B2 | 6/2011 | Liu et al. | |
| 8,572,932 | B2 * | 11/2013 | Bierschenk et al. | B65B 9/2049 53/451 |
| 2006/0185328 | A1 * | 8/2006 | Salicini et al. | 53/463 |
| 2007/0068122 | A1 | 3/2007 | Poppi | |
| 2007/0128386 | A1 | 6/2007 | Knoerzer et al. | |
| 2007/0163214 | A1 * | 7/2007 | Hauers et al. | 53/551 |
| 2010/0210438 | A1 * | 8/2010 | Nakagawa et al. | 493/186 |

FOREIGN PATENT DOCUMENTS

| | | | |
|---|---|---|---|
| JP | S5975401 | U | 5/1984 |
| JP | 6297611 | A | 10/1994 |
| JP | 2009214889 | | 9/2009 |
| JP | 2010006383 | | 1/2010 |
| KR | 1020030036628 | A | 9/2003 |
| WO | 9710152 | | 3/1997 |

* cited by examiner

METHOD FOR MAKING A FLAT BOTTOM PILLOW POUCH

BACKGROUND OF THE INVENTION

1. Technical Field

The present invention relates to a flat bottom pillow pouch constructed using a modified vertical form fill and seal packaging machine, and the method for making the same that provides for a single-piece construction of a bag suitable for retail snack food distribution.

2. Description of Related Art

Many snack foods, like chips, pretzels, etc. are packaged in pouches formed of a very thin packaging film. These packages can be manufactured on vertical form, fill, and seal packaging machines that, as the name implies, forms a package, fills it with product, and seals the filled package. An example of a vertical form, fill, and seal machine for making pillow-pouch packages is exemplified in FIG. 1 of U.S. Pat. No. 6,718,739. Such packaging machines take packaging film from a sheet roll and form the film into a vertical tube around a product delivery cylinder. The vertical tube is vertically-sealed along its length to form a back-seal. The machine applies a pair of heat-sealing jaws against the tube to form a transverse seal. This transverse seal acts as the top-seal on the bag below and the bottom-seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thereby making a bag and sealing the product within the bag while simultaneously forming a film tube above the product. The package below said transverse-seal is separated from the rest of the film tube by cutting across the sealed area. An example of the resultant standard pillow pouch bag is depicted by FIG. 3a of U.S. Pat. No. 6,722,106.

The packaging film used in such process is typically a composite polymer material produced by a film converter. For example, one prior art composite film used for packaging potato chips and like products in a standard pillow pouch bag uses a sealable inside, or product side, layer which typically comprises metalized oriented polypropylene ("OPP") or metalized polyethylene terephtalate ("PET"). A sealant layer disposed upon the product side of the metalized film enables a hermetic seal to be formed by the transverse sealing jaws at a temperature lower than the melt temperature of the film. Typical prior art sealant layers include an ethylene-propylene co-polymer and an ethylene-propylene-butene-1 ter-polymer. The metalized film layer, which is usually metalized with a thin layer of aluminum, provides excellent barrier properties.

Barrier properties in one or more layers are important in order to protect the product inside the package from light, oxygen or moisture. Such a need exists, for example, for the protection of foodstuffs, which may run the risk of flavor loss, staling, or spoilage if insufficient barrier properties are present to prevent transmission of such things as light, oxygen, or moisture into the package.

Adjacent to the metalized inside layer is a laminate layer, typically a polyethylene extrusion, and an outer ink or graphics layer. The ink layer is typically used for the presentation of graphics that can be viewed through a transparent outside layer, which layer is typically OPP or PET. The overall film thickness of this prior art film composition is typically less than 225 gauge. Such prior art film composition is well known in the art and disclosed in the discussion related to FIG. 1 in U.S. Pat. No. 7,189,300, which is hereby incorporated by reference.

The prior art film composition discussed above is ideally suited for use on vertical form and fill machines for the packaging of food products. The use of OPP or PET for the outside layer and the inside layer further makes it possible to heat seal any surface of the film to any other surface in forming either the transverse seals or back seal of a package.

Ideally, every seal on every package would be hermetic, or leak-proof, even under pressure changes. Without a hermetic seal, any barrier properties provided by the film are ineffective against oxygen, moisture, or aroma transmission between the product in the package and the outside. Hermetic seals are especially important with snack foods, so that flavor and freshness are preserved. Areas where the package has a back seal, folds, or gussets provide extra layers of material in the seal, but this problem becomes more acute with thicker packaging materials, additional folds in the package design, and smaller packages.

One problem with pillow-pouch packages is that they have a narrow, single-edge base made from the bottom transverse seal and therefore such prior art packages are not stable and are unable to stand independently (e.g., without leaning on something) on the bottom transverse seal. It would be desirable to have a pillow-pouch package capable of independently standing on its bottom-transverse seal.

FIGS. 1*a*-1*d* depict a vertical, stand-up pouch 100 having a front 102 defined by a top-transverse seal 120 and a bottom-transverse seal 130. Also depicted is a side 110 with a sealed gusset 112 adjacent to the bottom transverse seal 130 and an open gusset 114 adjacent the top transverse seal 120. A gusset is created on the side 110 of a package when four layers of film are captured because of film being pushed or folded inward and sealed together by the transverse sealing jaws when the transverse seal is made. It is not necessary that the transverse seals actually seal all four layers of packaging film together to form a gusset, as demonstrated by the open gusset 114. However, sealing all four layers together can result in a closed gusset 112.

Referring to FIGS. 1*c* and 1*d*, four layers of film are also sealed together in the vicinity of the middle of the rear face 106 of the package in the areas indicated by 127 137 if a fin seal is used as the backseal 140. Because such overlapping film is not on the side of the package and is not a result of being pushed inward or folded inward, such areas are not considered a gusset for purposes of this application.

As used herein, a "gusset" is defined as a gusset on the side 110 of a package and includes both open gussets 114 and closed gussets 112.

As shown, the front of the package 102 and the rear-package face 106 are bounded on the sides by heat-sealed creases 104 that run from the top transverse seal 120 to the bottom transverse seal 130. The package depicted in FIGS. 1*a*-1*d* is similar to the package disclosed in U.S. Pat. No. 5,398,486. The package depicted in FIGS. 1*a*-1*d* is constructed in a method similar to that described above with regard to prior art pillow-pouches. However, to form the side gussets 110 on either side of the bag, the vertical, form, fill and seal machine must be substantially modified by the addition of two moveable devices on opposite sides of the sealing carriage that move in and out to make contact with the packaging film to form the tuck that becomes the side 110 shown in FIGS. 1*a*-1*d*. Further, instead of using a single back-sealer to make a back seal 140, the package made in FIGS. 1*a*-1*d* require an additional heat sealing device for each crease 104 that is made in the package to provide additional stability to the package.

Consequently, a total of five vertical sealing devices are used. Methods for making such vertical creases 104 are described and taught in U.S. Pat. Nos. 5,862,652 and 3,785,112.

As discussed above, it is important that the transverse seals on every package made from this film be a hermetic or leak-proof, transverse seal. This is especially important with low moisture shelf-stable foods and/or other products that are susceptible to oxygen and/or moisture.

FIG. 1*d* is a top perspective rear view of the prior art package depicted in FIG. 1*a* and illustrates the relative position and portion of the problem areas 125 126 127 of the transverse seal 120. FIG. 1*e* is an exaggerated top cross-sectional view of the problem area 125 of the package depicted in FIG. 1*d*. Referring to FIGS. 1*d* and 1*e*, regions 121 and 123 of the top transverse seal 120 each have four film layers that must be sealed together while region 122 has only two layers except at the intersection of the backseal. Similarly, if a lap seal is used to make the back seal 140 the area 127 will have three layers of packaging film and if a fin seal is used, the area 127 will have four layers of packaging film. Because of the change in the number of layers of packaging film, triangularly-shaped capillary leaks, pin-hole leaks, or void spaces 150 (as depicted by FIG. 1*e*) can occur in packages when side gussets 110 are made in the packaging film. Similar void spaces occur in each problem area as shown by numerals 125 126 127. FIG. 1*c* depicts locations where these problem areas 135 136 137 can occur on the bottom, transverse seal 130. The problem areas can occur in packages having an open gusset 114 as shown by the top portion of the package in FIG. 1*d* or in packages having a closed gusset 112 as shown the problem areas 135 136 137 illustrated by the bottom portion of the package in FIG. 1*c*.

The prior art solutions to overcoming pinhole leaks requires the film from prior art pillow packages to be modified in some manner. For example, while the top and bottom transverse seals 120 130 have the potential of having a problem areas 127 137, as depicted by FIGS. 1*c* and 1*d*, such problem areas can be addressed by use of the film disclosed in U.S. Patent Application Publication No. 2007/0128386, assigned to the same Assignee as the present invention.

Unfortunately, such prior art solution still requires film modification may not adequately address the problem areas 125 126 135 136 that can facilitate oxygen and moisture penetration into a package via the capillary void space 150 as depicted in FIG. 1*e*.

Another prior art solution for overcoming pinhole leaks is to add two or three times more sealant to the product facing layer, such as the product facing OPP layer. Another solution to overcoming such shortcoming is to use an additional film layer to try to fill up the capillary void space. The additional film layer is typically a 1 to 2.5 mil (100 to 250 gauge) linear low density polyethylene that must be laminated to the inner metalized OPP layer. Consequently, such films typically require a tandem lamination to make the requisite multi-layer film and substantially more film material must be used than is required for a standard pillow pouch package. The thickness of a film typically used for packages having gussets is usually greater than 300 gauge, which is at least about 33% more film than used in standard pillow pouch packages.

For example, U.S. Pat. No. 7,122,234 teaches that laminates used to make such packages require sufficient bending stiffness to be suitable for continuous high speed packaging. The '234 Patent teaches that sufficient stiffness occurs when the laminate thickness exceeds 110 micrometers or 433 gauge units (1 micron or micrometer=3.937 gauge; 100 gauge=1 mil=0.001 inches). European Patent Application 1 283 179 discloses a microwave heatable food product package associated with the trade name TETRAWEDGE. When measured, the TETRAWEDGE package revealed a thickness of 12.5 mil or 1250 gauge. One apparent consequence of using such thick material is that a crease pattern is applied to the packaging material prior to package formation to permit the material to be folded along inclined lateral corners and along base corners. Similarly, U.S. Pat. No. 5,508,075 discloses the need for crease lines to be stamped or otherwise impressed into the surface of the packaging material. It would be desirable to make a flat bottom pillow pouch using the same film as is used with prior art pillow packages without compromising the hermetic sealing properties of the transverse seal.

In one aspect, the package should be made to avoid open or closed gussets and to minimize the problem areas at an upper or lower transverse seal that occurs because of a change in the number of layers and regions of transition that can create capillary void spaces 150 in the transverse seals. In one aspect, the package should have three or more distinct edges defining the package bottom to permit the package to stand upright on the bottom transverse seal. In one aspect, the package should be made of the same film material and utilize the same film thickness used to make standard pillow pouch packages. In one aspect, the package is made with a film material without the need for crease lines to be stamped or otherwise impressed into the package film.

SUMMARY OF THE INVENTION

The present invention in one embodiment is directed towards a method of making a flat bottom pillow pouch comprising the steps of forming a bottom transverse seal, using an extension to form a package bottom with defined edges and flaps, folding the transverse seal, and folding the flaps beneath the package. In one embodiment, the present invention is directed towards a flat bottom pillow pouch having no gussets wherein the pouch stands on the bottom transverse seal. In one embodiment, the present invention is directed towards an improved vertical form fill and seal machine comprising an extendable and retractable extension below a product tube, a folding device for folding a transverse seal, and at least two side folding members to fold flaps formed by the extension in the extended position.

Other aspects, embodiments and features of the invention will become apparent from the following detailed description of the invention when considered in conjunction with the accompanying drawings. The accompanying figures are schematic and are not intended to be drawn to scale. In the figures, each identical, or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention. All patent applications and patents incorporated herein by reference are incorporated by reference in their entirety. In case of conflict, the present specification, including definitions, will control.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1B:
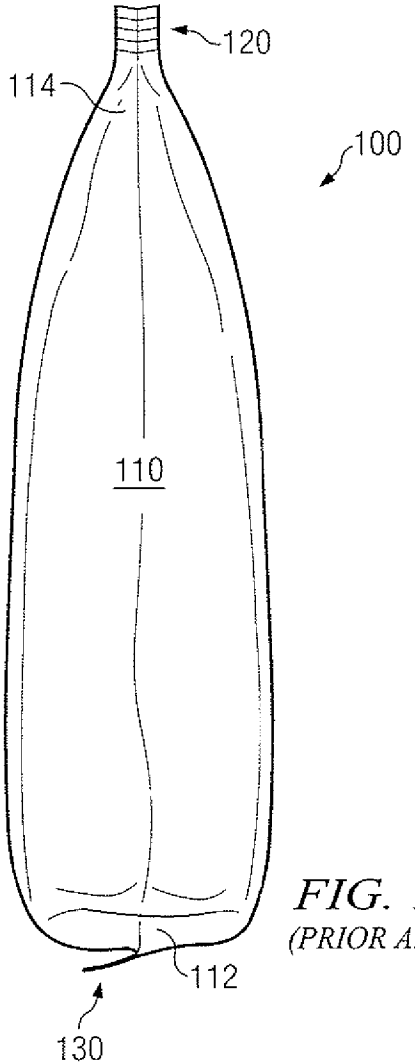
FIG. 1b (PRIOR ART)
FIG. 1*b* is a side view of the prior art package depicted in FIG. 1*a*.
Figure 1A:
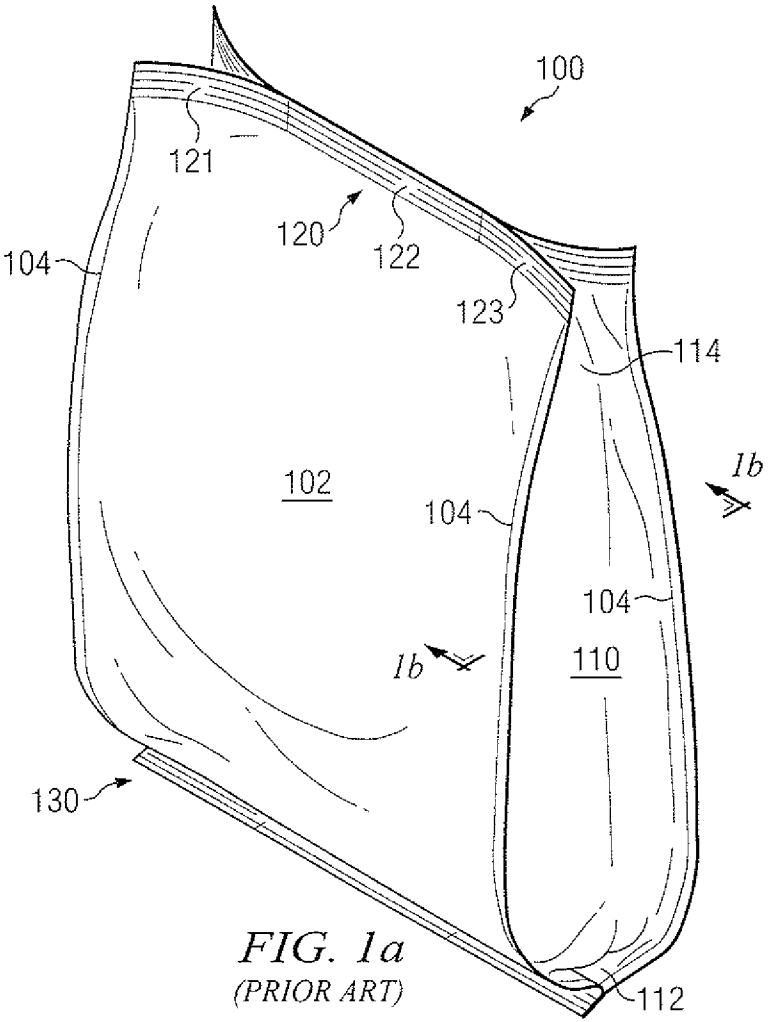
FIG. 1a (PRIOR ART)
FIG. 1*a* is a front perspective view of a prior art package that stands on the bottom transverse seal.
Figure 1D:
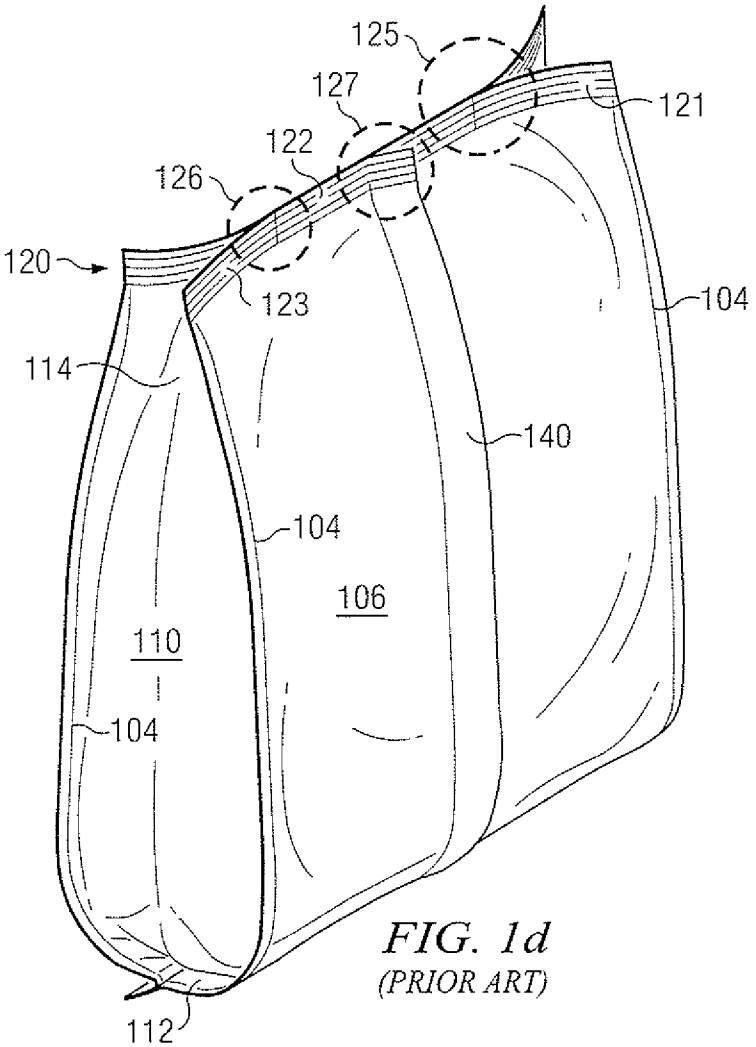
FIG. 1d (PRIOR ART)
FIG. 1*d* is a top rear perspective view of the prior art package depicted in FIG. 1*a*.
Figure 1C:
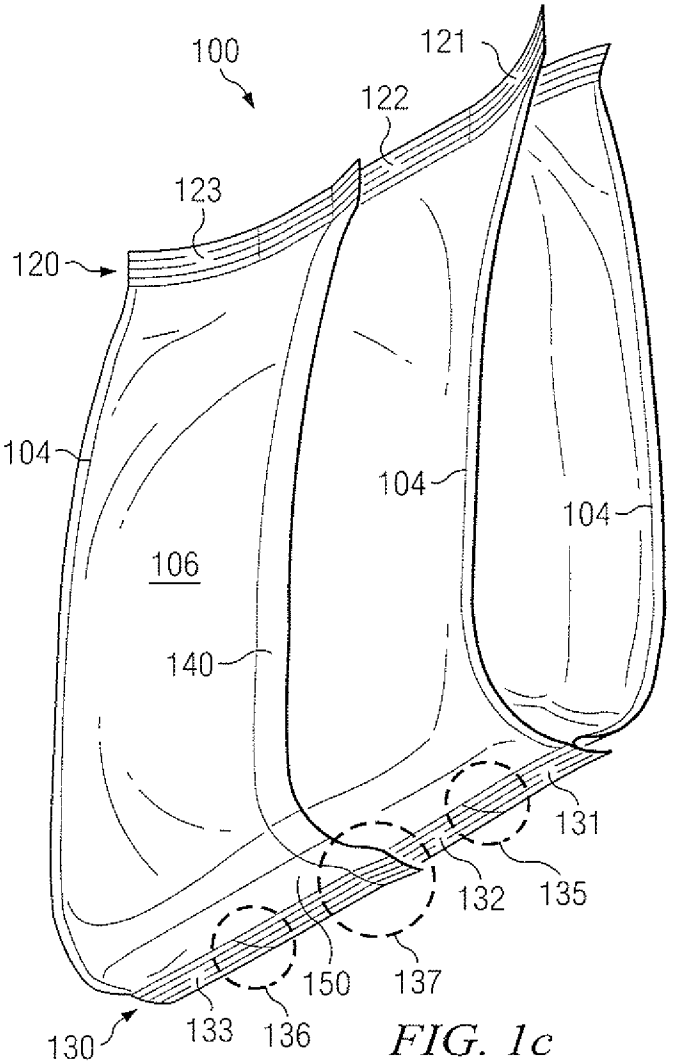
FIG. 1c (PRIOR ART)
FIG. 1*c* is a bottom rear perspective view of the prior art package depicted in FIG. 1*a*.
Figure 1E:
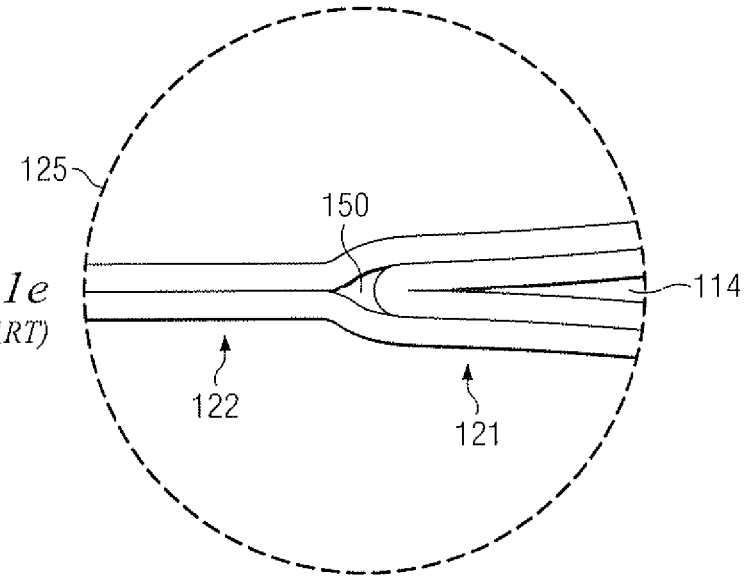
FIG. 1e (PRIOR ART)
FIG. 1*e* is a top cross-sectional view of a portion of the package depicted in FIG. 1*d*.
Figure 2A:
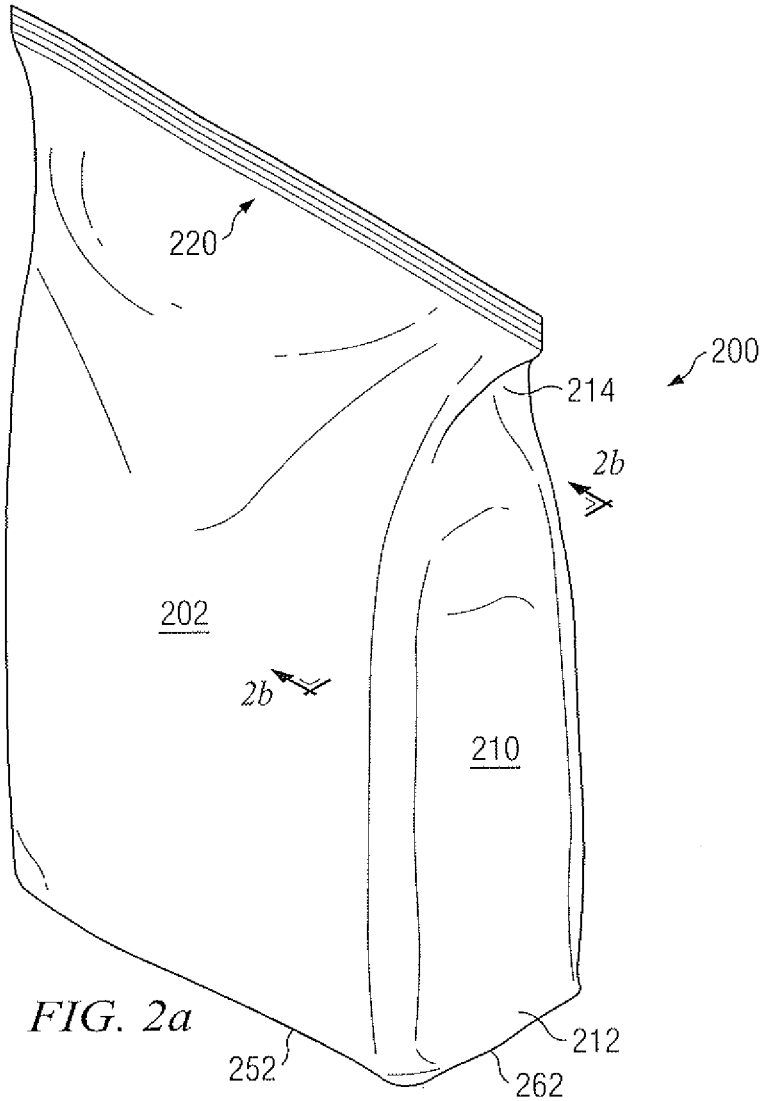
FIG. 2*a* is a front perspective view of a flat bottom pillow pouch made in accordance with one embodiment of the present invention.
Figure 2C:
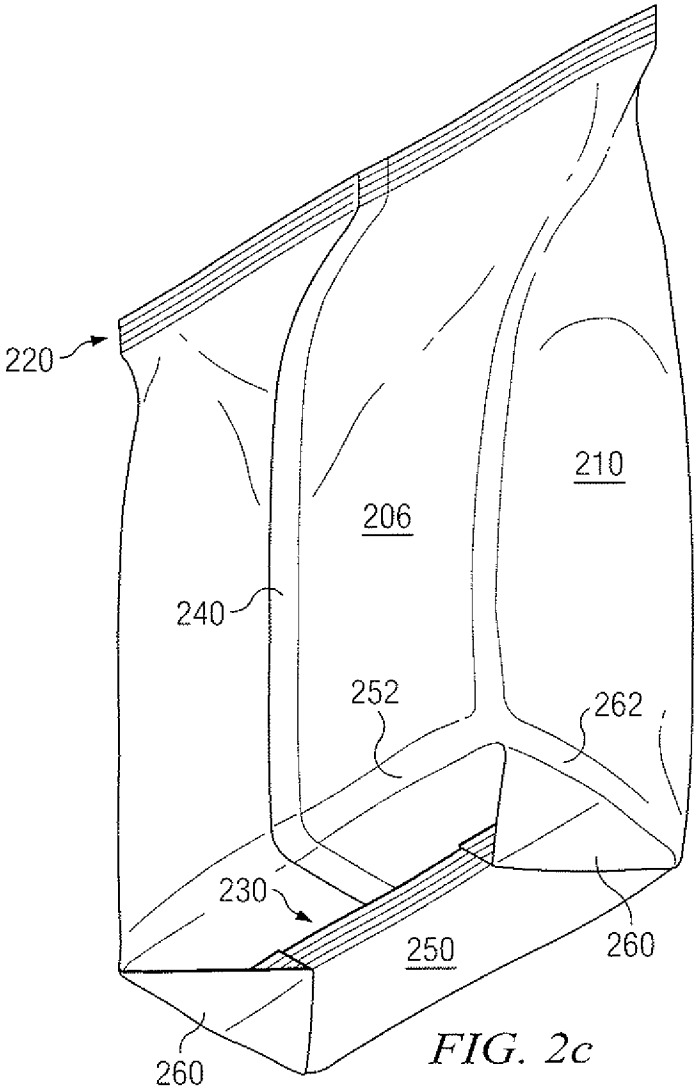
FIG. 2*c* is a rear bottom-perspective view of the package depicted in FIG. 2*a*.
Figure 2B:
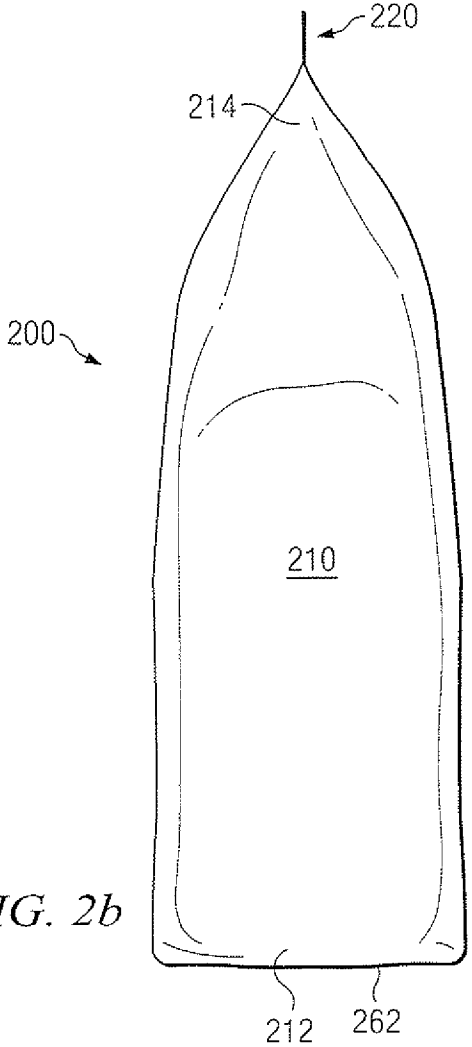
FIG. 2*b* is a side view of the package depicted in FIG. 2*a*.
Figure 2D:
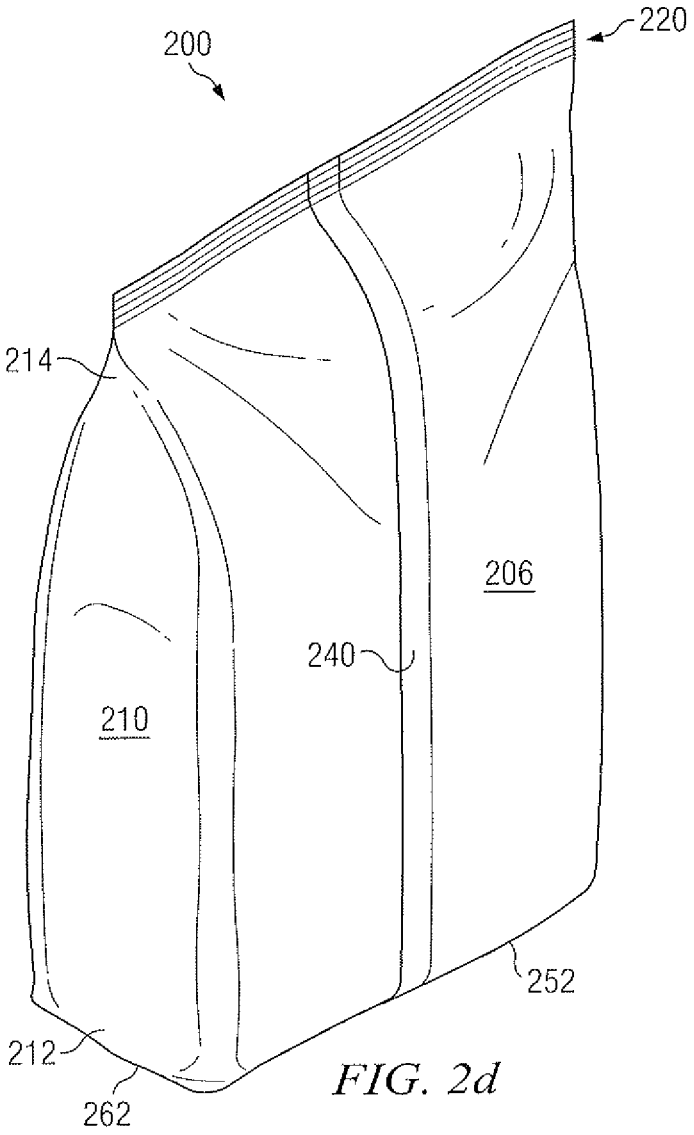
FIG. 2*d* is a top rear perspective-view of the package depicted in FIG. 2*a*.
Figure 3A:
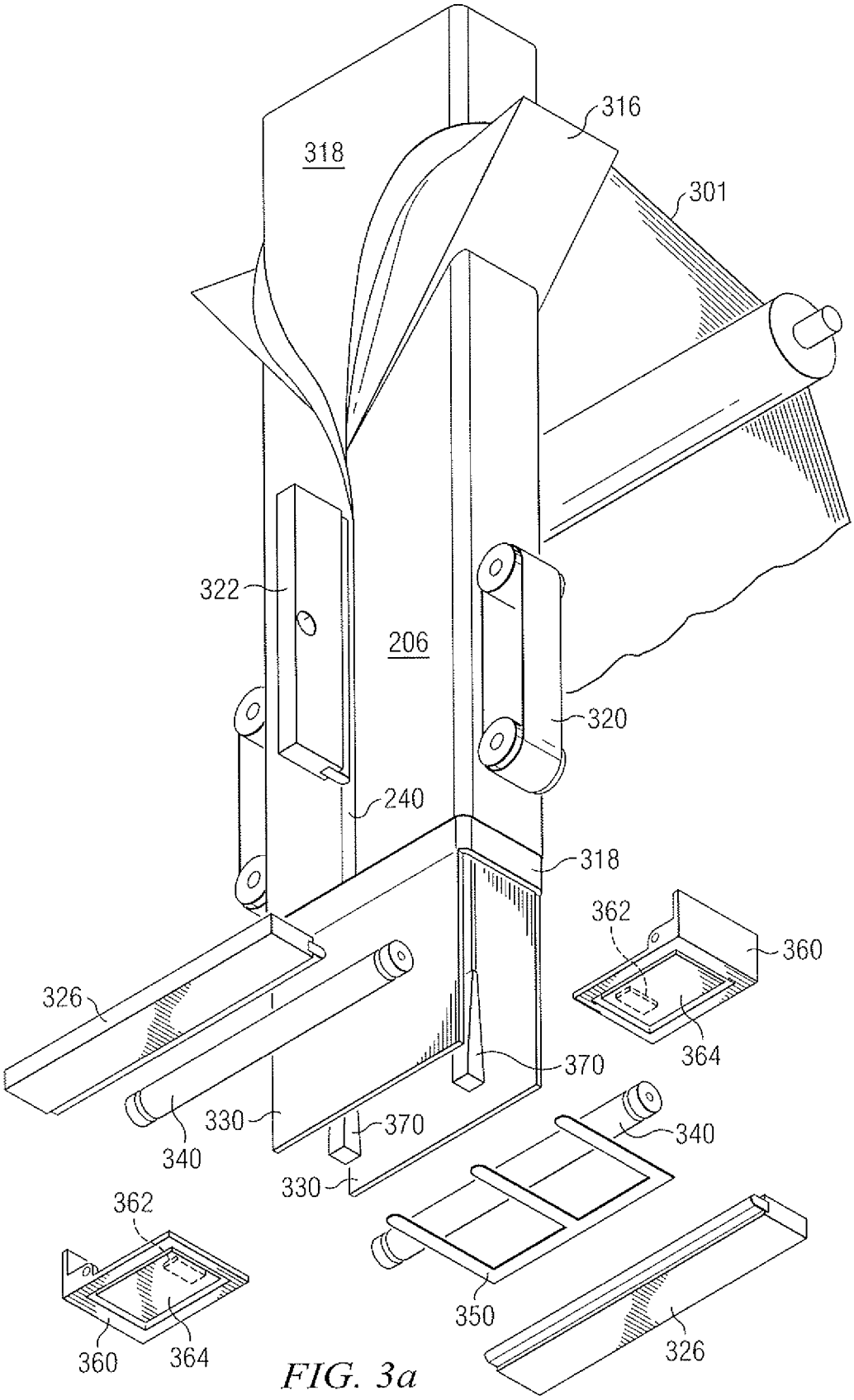
FIGS. 3*a*-3*g* are perspective views showing the sequence of operation of the formation of a package in accordance with one embodiment of the present invention.

FIG. 2*a* is a top front perspective view of a flat bottom bottom pillow pouch package made in accordance with one embodiment of the present invention. FIG. 2*b* is a side view of the package depicted in FIG. 2*a*. FIG. 2*c* is a rear bottom-perspective view of the package depicted in FIG. 2*a*. FIG. 2*d* is a top rear perspective-view of the package depicted in FIG. 2*a*. Referring to FIGS. 2*a*-2*d*, in one embodiment, the present invention comprises a flat-bottom, pillow-pouch bag or package 200 having no pleats or gussets along the side of a package. Rather the package of the present invention, in one embodiment comprises a side 210 between the front face 202 and the rear face 206, that tapers upwardly from the bottom portion 212 adjacent the bottom edge 262 upwardly to the top transverse seal 220. Consequently, the area 214 near the top transverse seal 220 of the present invention is much like the area near the top transverse seal of a prior art pillow-pouch bag as depicted by FIG. 3a of U.S. Pat. No. 6,722,106 because both packages have no gussets adjacent to the top transverse seal as clearly shown by FIGS. 2*a*-2*d*.

Referring to FIG. 2*c*, the package of the present invention comprises a pair of inwardly-folded ears 260 that are positioned beneath the package bottom 250. FIG. 2*c* further depicts the bottom transverse seal 230 oriented as substantially perpendicular to the top transverse seal 220. In one embodiment, a portion of the bottom transverse seal 230 on the inwardly folded ears 260 is heat scaled to the bottom 250. The package bottom 250 as depicted is substantially rectangular in shape. In one embodiment, the periphery of the package bottom 250 comprises a substantially perpendicular front and rear edge 252 such that the bottom 250 is substantially perpendicular to the front 202 and rear 206. In one embodiment, the periphery of the package bottom 250 comprises a substantially perpendicular side edge 262 such that the bottom 250 is substantially perpendicular to the side 210. Those skilled in the art will recognize that the front 202, rear 206, and sides 210 will be slightly less than perpendicular to the bottom 250 because of the tapering of the sides 210 of the package from bottom to top.

FIGS. 3*a*-3*g* are perspective views showing the sequence of operation of the formation of a package on an improved vertical form fill and seal machine in accordance with one embodiment of the present invention. For purposes of simplification, the top portion of the vertical form fill and seal machine has been omitted from FIGS. 3*b*-3*g*. Flexible packaging film 301 having barrier properties is taken from a roll of film (not shown) and passed over a former 316 which directs the film into a vertical tube around a product delivery tube 318, as depicted in FIG. 3*a*. As used herein, flexible packaging film having barrier properties is defined as flexible film having an oxygen transmission rate of less than about 150 cc/m$^2$/day (ASTM D1434) and a water vapor transmission rate of less than about 5 grams/m$^2$/day (ASTM F372-99).

Figure 5A:
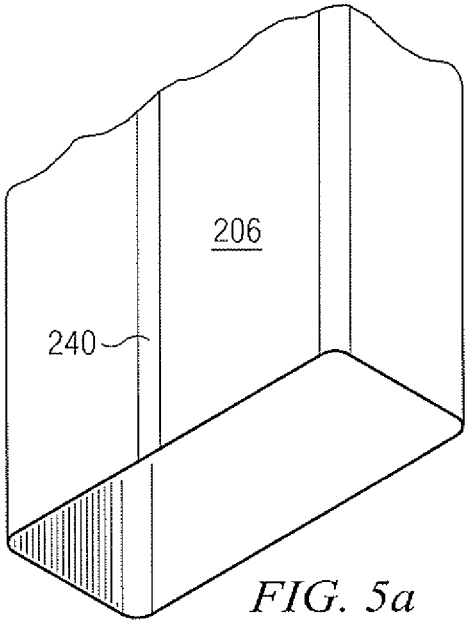
FIGS. 5*a*-5*d* are perspective views showing the sequence of operation of the formation of the packaging film in accordance with one embodiment of the present invention.

FIGS. 5*a*-5*d* are perspective views showing the sequence of operation of the formation of the packaging film in accordance with one embodiment of the present invention. The formation of the package shown in FIGS. 2*a*-2*d* will now be described with reference to FIGS. 3*a*-3*g* and FIGS. 5*a*-5*d*. As shown by FIGS. 3*a* and 5*a*, while the tube is pulled downward by drive belts 320, the vertical tube of film is sealed along its length by a vertical sealer 322, forming a back-seal 240. As shown in FIG. 3*a*, the product delivery tube 318 comprises an extension 330 beneath the product delivery tube 318. In the embodiment shown the extension 330 comprises a pair of flaps in the extended position. As used herein, the extended position refers to an extension 330 that is oriented in a manner which creates outward tension on the film tube upon completion of the bottom transverse seal 230. In the embodiment shown, the extended position occurs when the extension 330 is parallel to the portion of the product delivery tube 318 to which the extension 330 is attached.

Figure 3B:
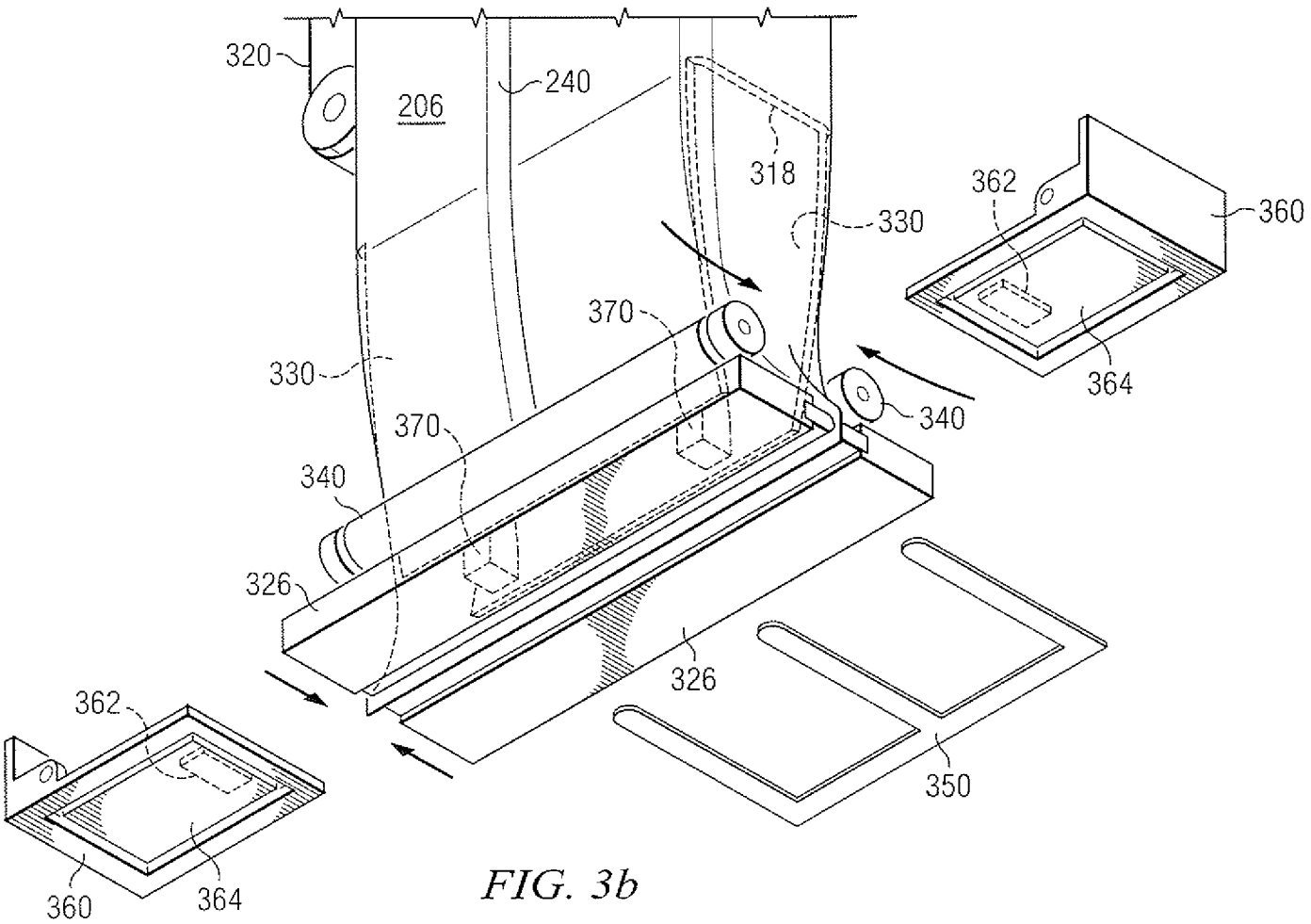
Figure 5B:
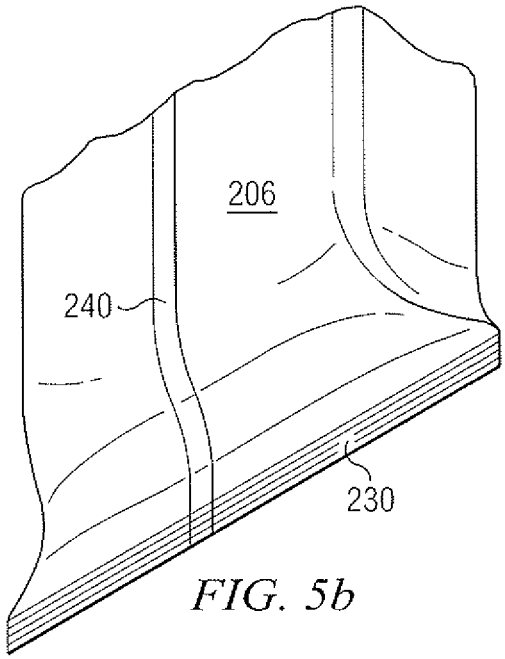

Referring to FIGS. 3*b* and 5*b*, the sheet of film 301 is pulled downward below the product delivery tube 318. The bottom end-seal 230 is made with a pair of sealing jaws 326 beneath the product delivery tube 318 having an extension 330 in the retracted position to form an open-ended tube. As used herein, the retracted position refers to an extension 330 position that permits a bottom transverse end-seal to be made beneath the product delivery tube 318 with a pair of sealing jaws 326. The flexible flaps comprising the extension 330 shown in FIG. 3*b* can be made of 0.035 inches of spring steel or any suitable flexible material. Such embodiment advantageously permits the flexible flaps to flex inwardly into a retracted position via actuation of a closing mechanism 340 to permit the sealing jaws 326 to close to form a transverse seal to minimize or eliminate the creation of tucks or pleats.

Figure 3C:
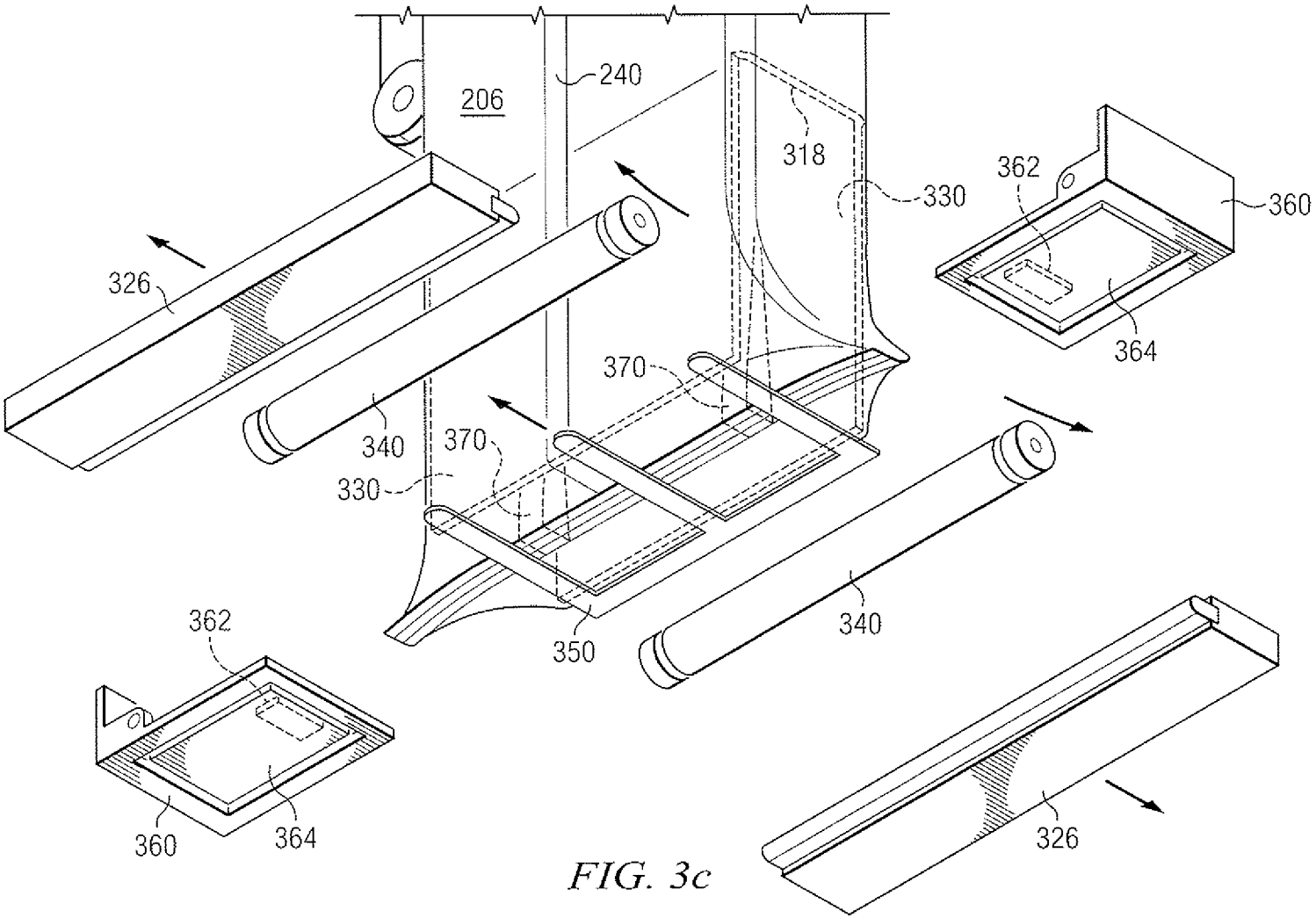
Figure 5C:
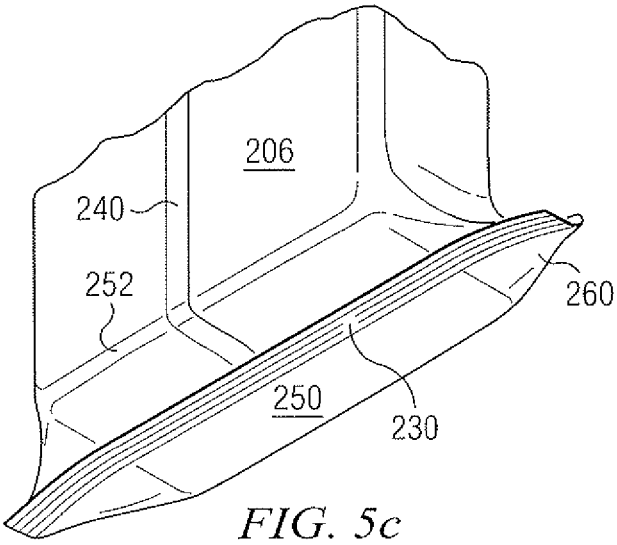

As shown by FIGS. 3*c* and 5*c*, upon completion of the bottom transverse seal, the closing mechanism 340 is released, and the flexible flaps 330 automatically flex back outwardly back into the extended position thereby defining the package bottom 250 having a pair of outwardly-extending flaps 260, as best shown by reference to FIG. 5*c*. The transverse seal 230 moves upward in elevation as the extension 330 moves into the extended position and as the package bottom 250 becomes defined. A folding device 350, at an elevation higher than the sealing jaws 326 can then be engaged beneath the extended extension 330 to fold the bottom transverse seal 230. In one embodiment, the residual heat imparted by the heat sealing jaws 326 on the bottom transverse seal causes the folded bottom transverse seal to stick to the bottom of the package when the folding device 350 has been engaged. In one embodiment, the folding device 350 comprises heated edges. After the folding device 350 has been engaged, the flaps 260 advantageously bend downward. Such bending of the flaps 260 can help ensure the side folding members 360 can engage the flaps 260 as discussed below. Product can be dropped through the product delivery tube 318 any time after the forks 350 have been engaged and the bottom seal 230 (as shown in FIG. 5*c*) has been folded over.

Figure 3D:
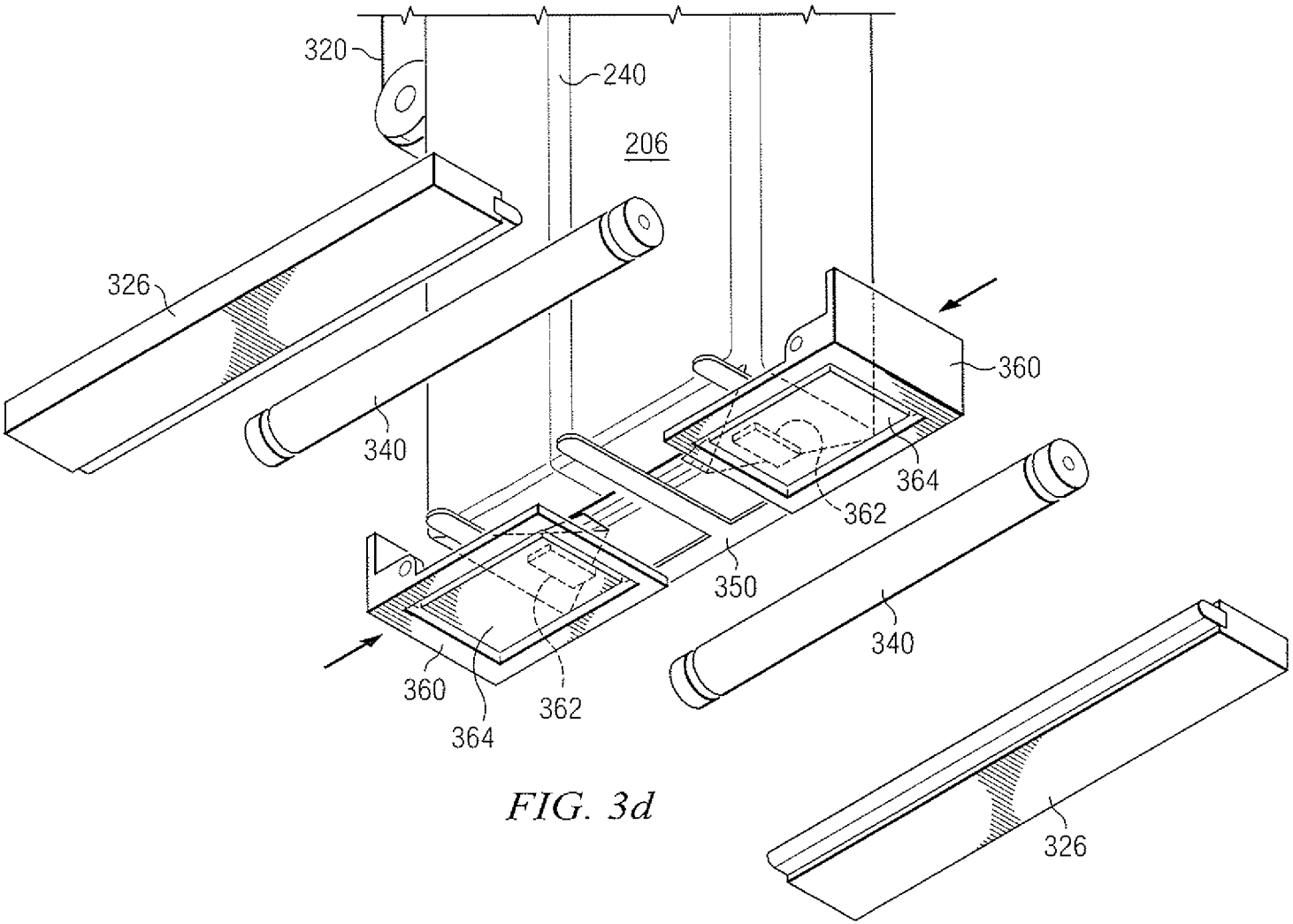
Figure 5D:
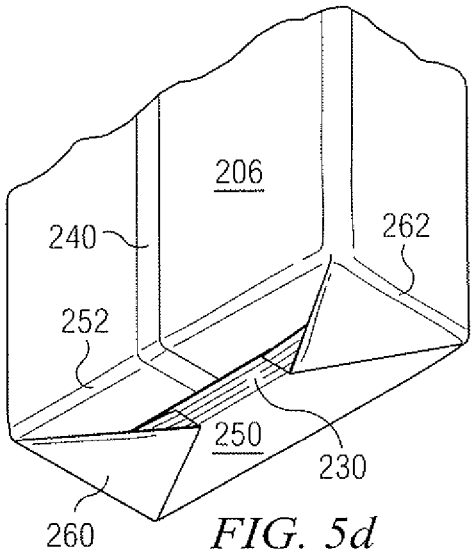

FIG. 3*d* depicts another step of the package formation in accordance with one embodiment of the present invention. The side folding members 360 are positioned in elevation such that the side folding members 360 are below the folding device 350 and above the terminal ends of the flaps 260. As shown in FIGS. 3*d* and 5*d*, a pair of side folding members 360 fold each of said flaps 260 inwardly and beneath the package bottom 250. In one embodiment, the folding device 350 remains beneath the package bottom 250 while the folding members 360 fold the flaps 260 beneath both the package bottom 250 and the folding device 350. In one embodiment, heat from the folding device 350 and/or the folding members 360 softens the outer film layers of the flaps 260 and the package bottom 250 which helps fuse and seal the flaps 260 to the package bottom 250. In one embodiment, the folding device 350 comprises a fork having at least two fingers. In one embodiment, the folding device 350 comprises a three-fingered fork which advantageously provides an open area for contact between the package bottom 250 and flaps 260 as shown in FIG. 3*d*. In one embodiment, because the bottom transverse seal 230 is still relatively hot from the heated sealing jaws 326, the bottom transverse seal on the flaps 260 is sealed via residual heat to the bottom transverse seal on the package bottom 250 in the open areas between the folding device 350 fingers. In one embodiment, a pedestal 370 (shown in FIG. 3*c*) is disposed below the product delivery tube 318 and inside the extension 330. In one embodiment, the pedestal 370 is substantially flush in elevation with the extension 330 when the extension 330 is in the extended position.

Figure 3E:
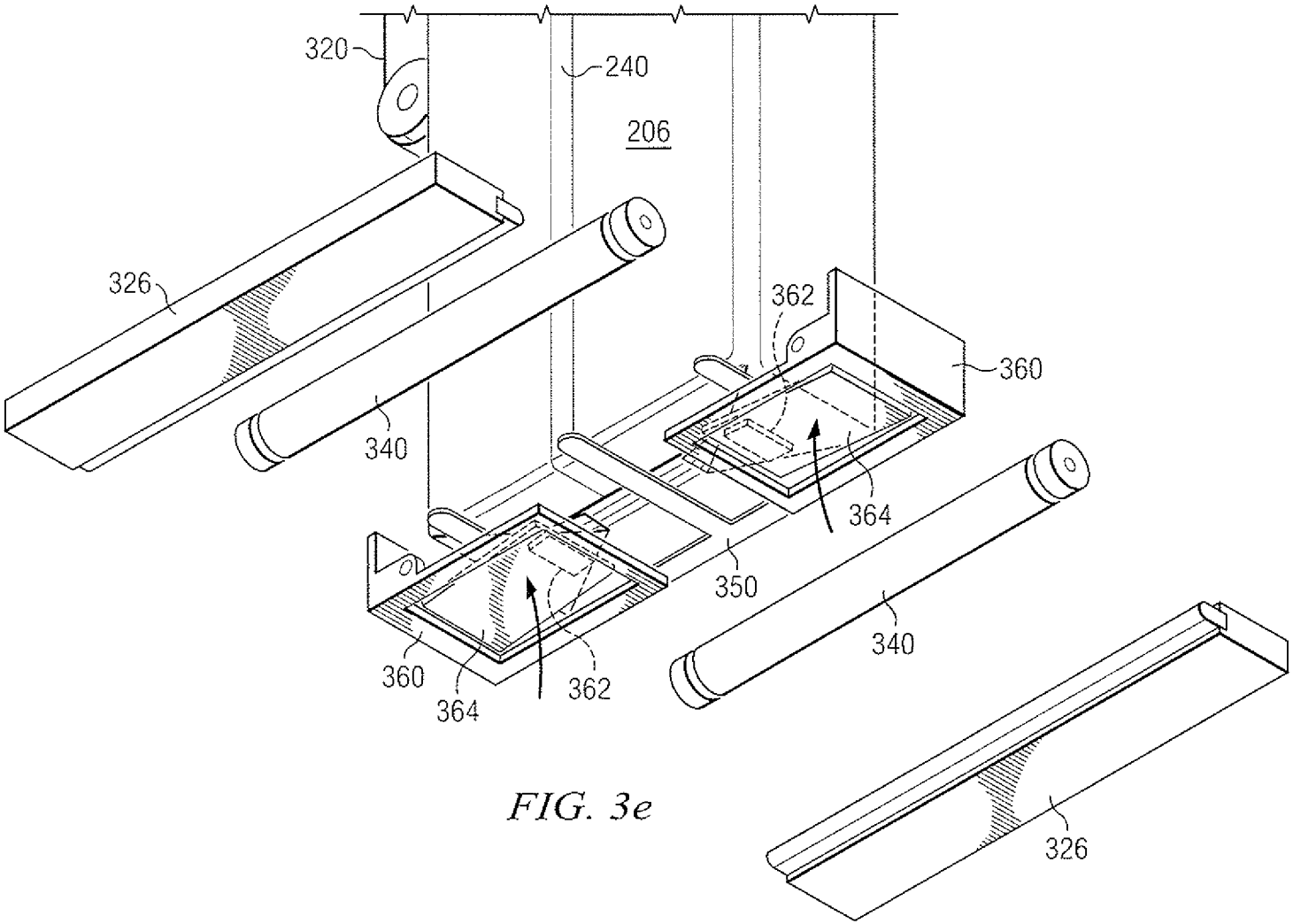

FIG. 3*e* is a bottom perspective view of the next sequential step in accordance with one embodiment of the present invention. As shown in FIG. 3*e*, the side folding member 360 comprises a mount 364 for a pivoting extension 362. After the side folding members 360 have folded the flaps 260 beneath the package bottom 250, a pivoting extension 362 placed on a mount 364 that is flush with each side folding member 360 is moved upward in the direction depicted by the arrows so as to engage the pedestal 370, the pedestal 370 being depicted in FIG. 3*c*. Consequently, referring to FIGS. 3*e* and 5*d*, the pivoting extensions 362 apply vertical pressure between the respective flaps 260 and the package bottom 250. The pedestal 370 (depicted in FIG. 3*c*) holds the package bottom in place 250 such that pressure is applied between the flaps 260 and the package bottom 250. In one embodiment, because the transverse seal 230 has residual heat from the heat sealing jaws, and because of the pressure applied by the pivoting extension 362 against the flaps and the pedestal 370, the portion of the transverse seal from the flaps 260 is sealed to the portion of the transverse seal on the package bottom 250. In one embodiment the side folding members 360 can be heated and in one embodiment the pivoting extension 362 and/or the pedestal 370 is heated to further facilitate the seal between the flaps 260 and the package bottom.

Figure 3F:
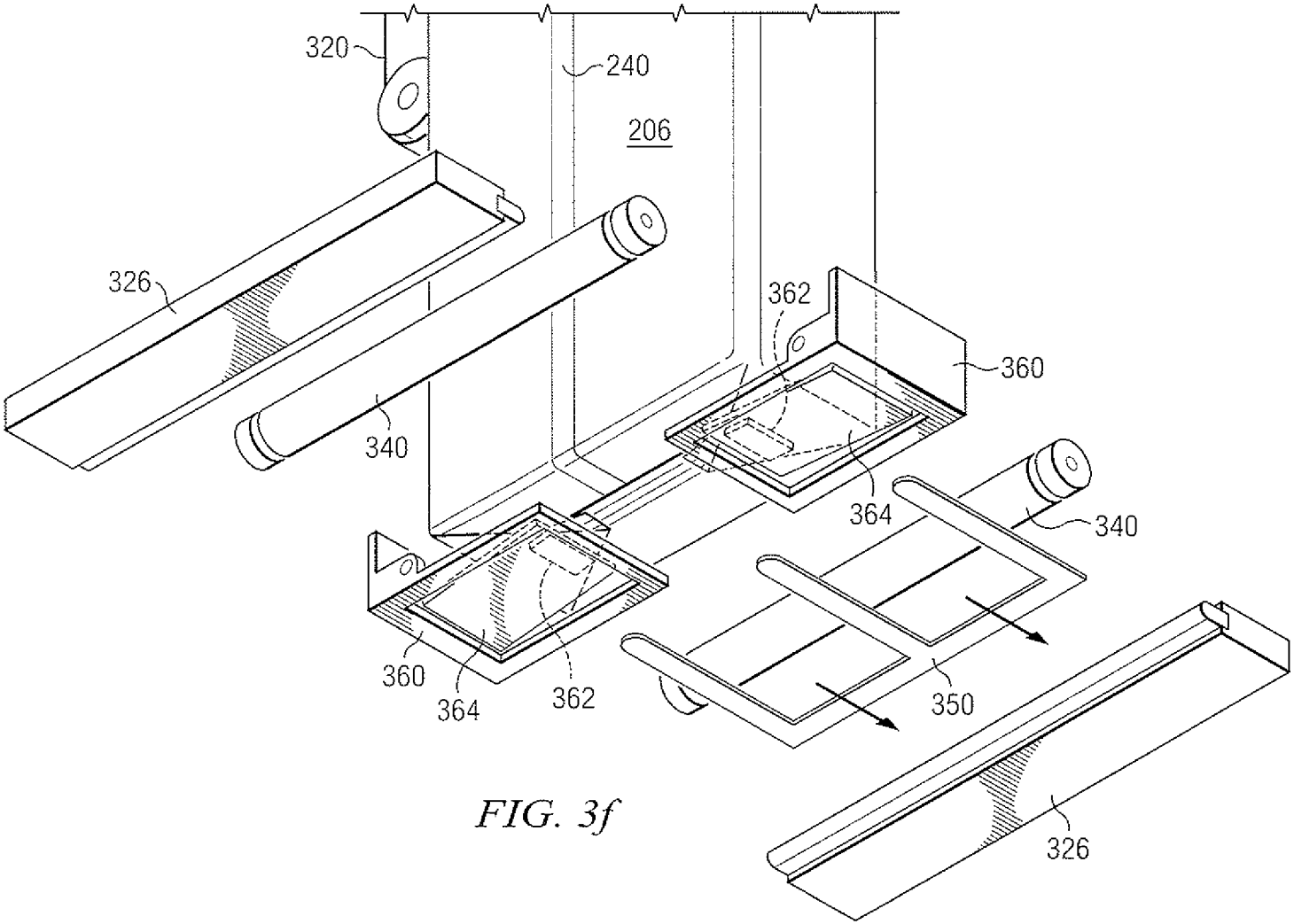

FIG. 3*f* is a bottom perspective view of the next sequential step in accordance with one embodiment of the present invention. Once the flaps 260 have been folded inwardly and optionally sealed to the package bottom 250, the folding device 350 can then be removed from beneath the package bottom 250.

Figure 3G:
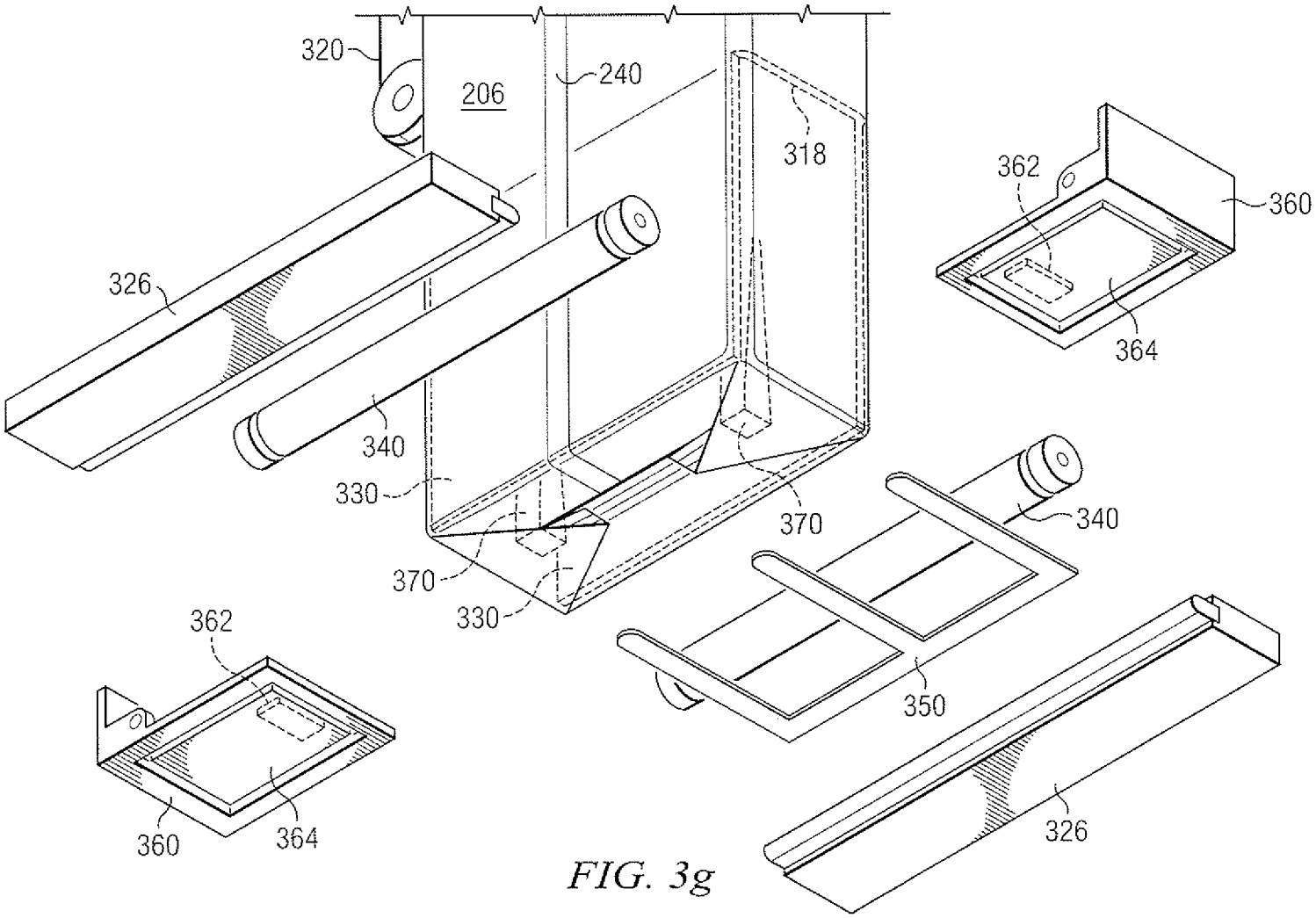

FIG. 3*g* is a bottom perspective view of one step of the present invention. As shown in FIG. 3*f*, the folding members 360 can then be moved outwardly from beneath the package bottom 250. The sheet of film can then be pulled downwardly prior to making the top transverse seal.

Figure 4A:
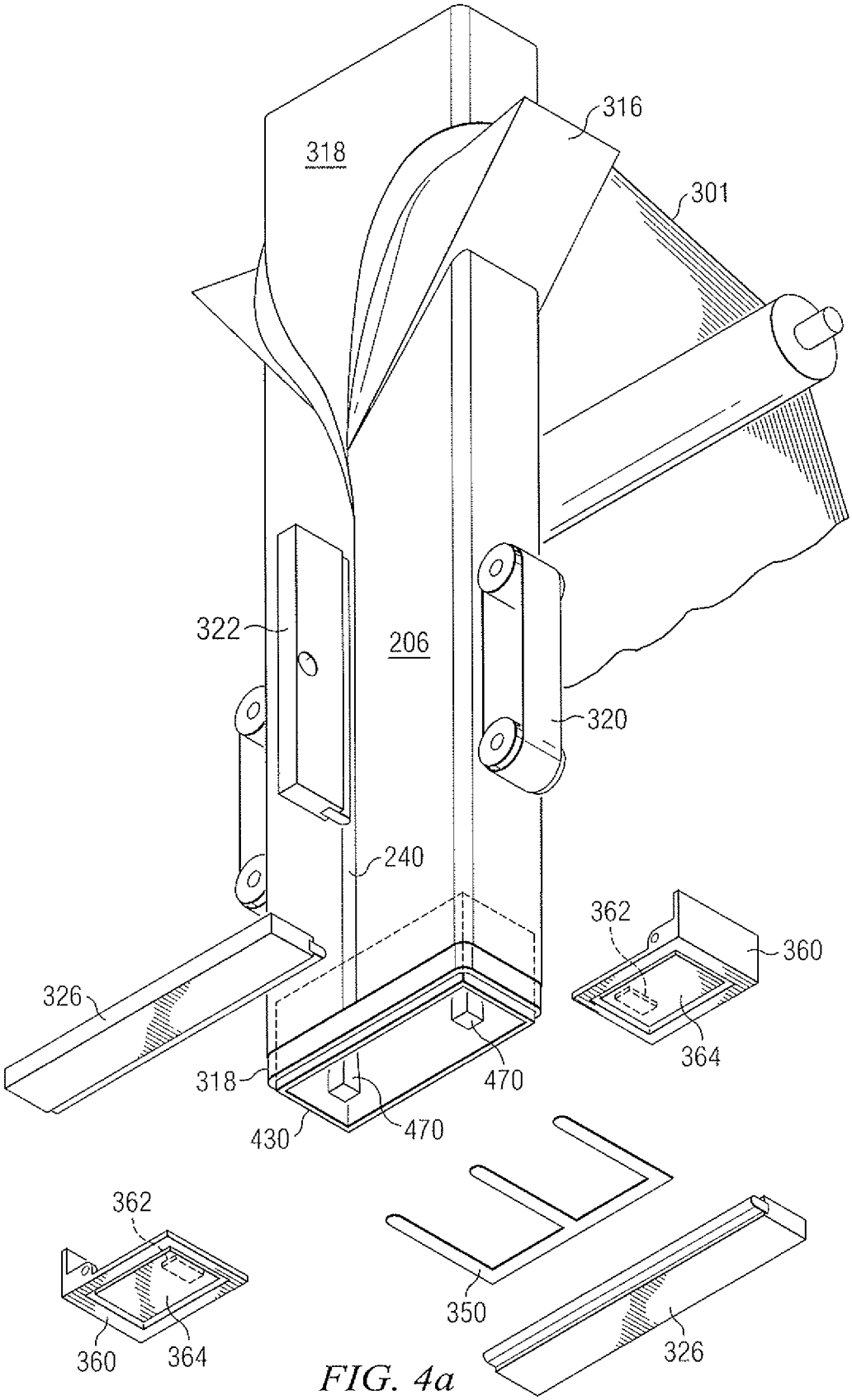
FIGS. 4*a*-4*g* are perspective views showing the sequence of operation of the formation of a package in accordance with one embodiment of the present invention.

FIGS. 4*a*-4*g* are perspective views showing the sequence of operation of the formation of a package on an improved vertical form fill and seal machine in accordance with one embodiment of the present invention. For purposes of simplification, the top portion of the vertical form fill and seal machine has been omitted from FIGS. 4*b*-4*g*. Flexible packaging film 301 having barrier properties is taken from a roll of film (not shown) and passed over a former 316 which directs the film into a vertical tube around a product delivery tube 318. While the tube is pulled downward by drive belts 320, the vertical tube of film is sealed along its length by a vertical sealer 322, forming a back-seal 240. As shown in FIG. 4*a*, the product delivery tube 318 comprises an extension 430 beneath the product delivery tube 318. In the embodiment shown in FIG. 4*a*-4*f*, the extension 430 comprises a telescoping extension that is slidably movable in the vertical direction between a retracted position and an extended position. The telescoping extension can be movably disposed within the product delivery tube 318 and the telescoping extension can be attached to a control cylinder via a pneumatically operated or other suitable rod assembly to move the telescoping extension as needed. Such telescoping extensions are known in the art as illustrated by U.S. Pat. No. 5,505,040, which is hereby incorporated by reference.

Figure 4B:
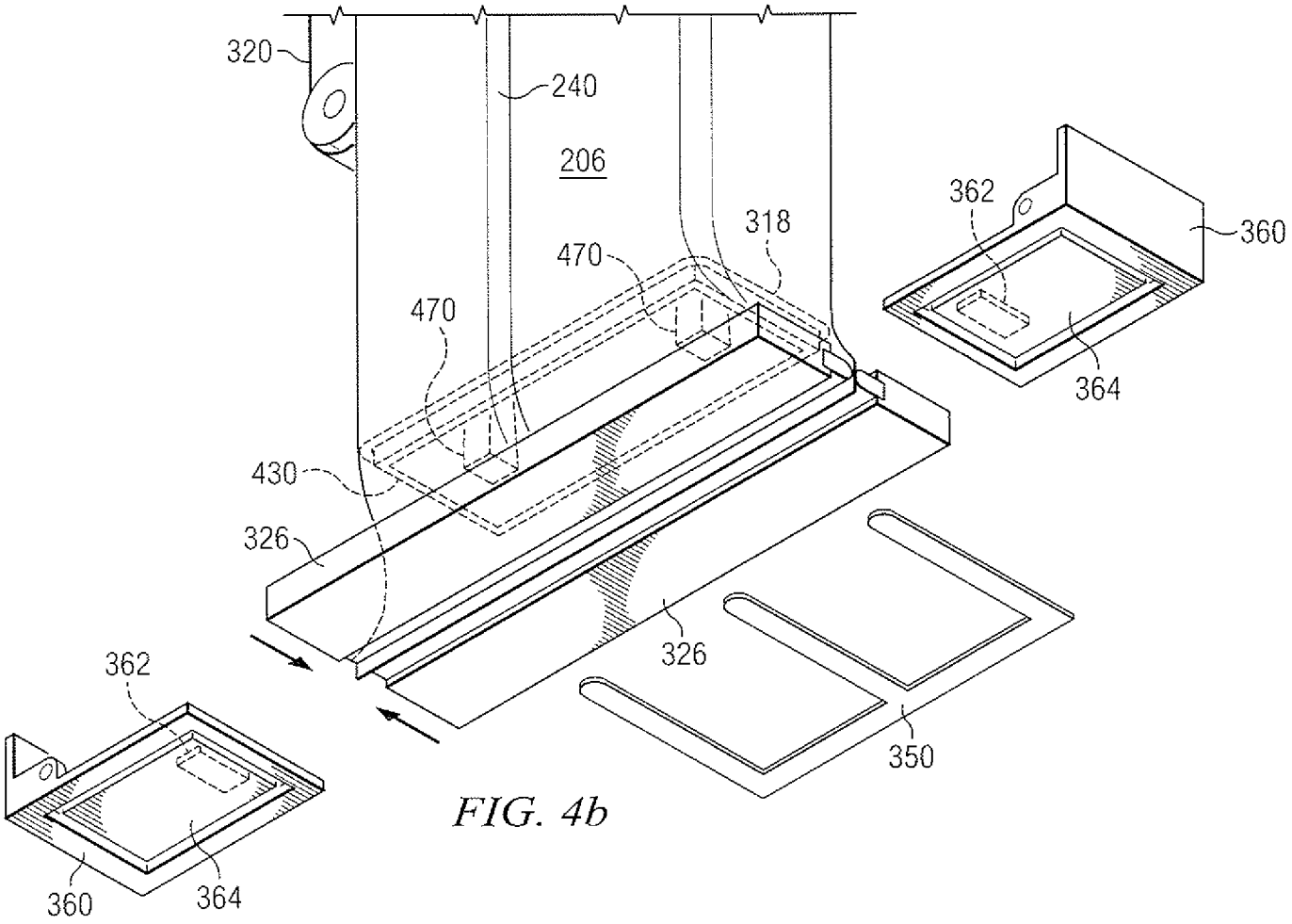

Referring to FIG. 4*b*, the sheet of film 301 is pulled downward below the product delivery tube 318. Referring to FIGS. 4*b* and 5*b*, the bottom end-seal 230 is made with a pair of sealing jaws 326 beneath the product delivery tube 318 having an extension 430 in the retracted position.

Figure 4C:
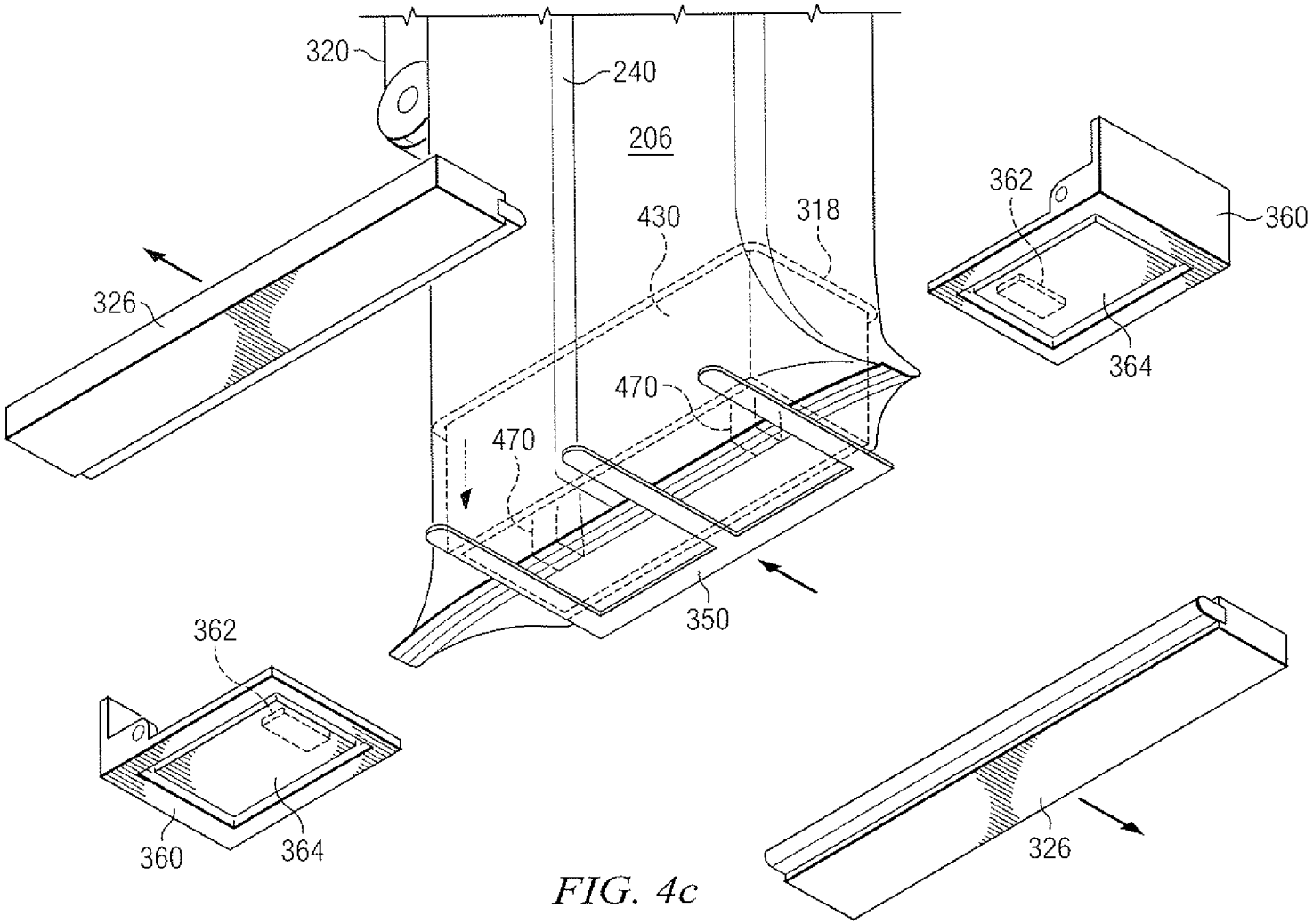

As shown by FIGS. 4*c* and 5*c*, upon completion of the bottom transverse seal 230, the extension 430 is slid into an extended position thereby forming the package bottom 250 having a pair of outwardly-extending flaps 260, as best shown by reference to FIG. 5*c*. The transverse seal 230 moves upward in elevation as the extension moves into the extended position and as the package bottom 250 becomes defined.

A folding device 350 at an elevation higher than the sealing jaws 326 can then be engaged beneath the extended extension 430 to fold the bottom transverse seal 230. In one embodiment, the residual heat on the bottom transverse seal from the heat sealing jaws 326 causes the folded bottom transverse to stick to the bottom of the package when the folding device 350 has been engaged. In one embodiment, the folding device 350 comprises heated edges. After the folding device 350 has been engaged, the flaps 260 advantageously bend downward. Such bending of the flaps 260 can help ensure the side folding members 360 can engage the flaps 260 as discussed below. Product can be dropped through the product delivery tube 318 anytime after the forks 350 have been engaged and the bottom seal (as shown in FIG. 5*c*) has been folded over.

Figure 4D:
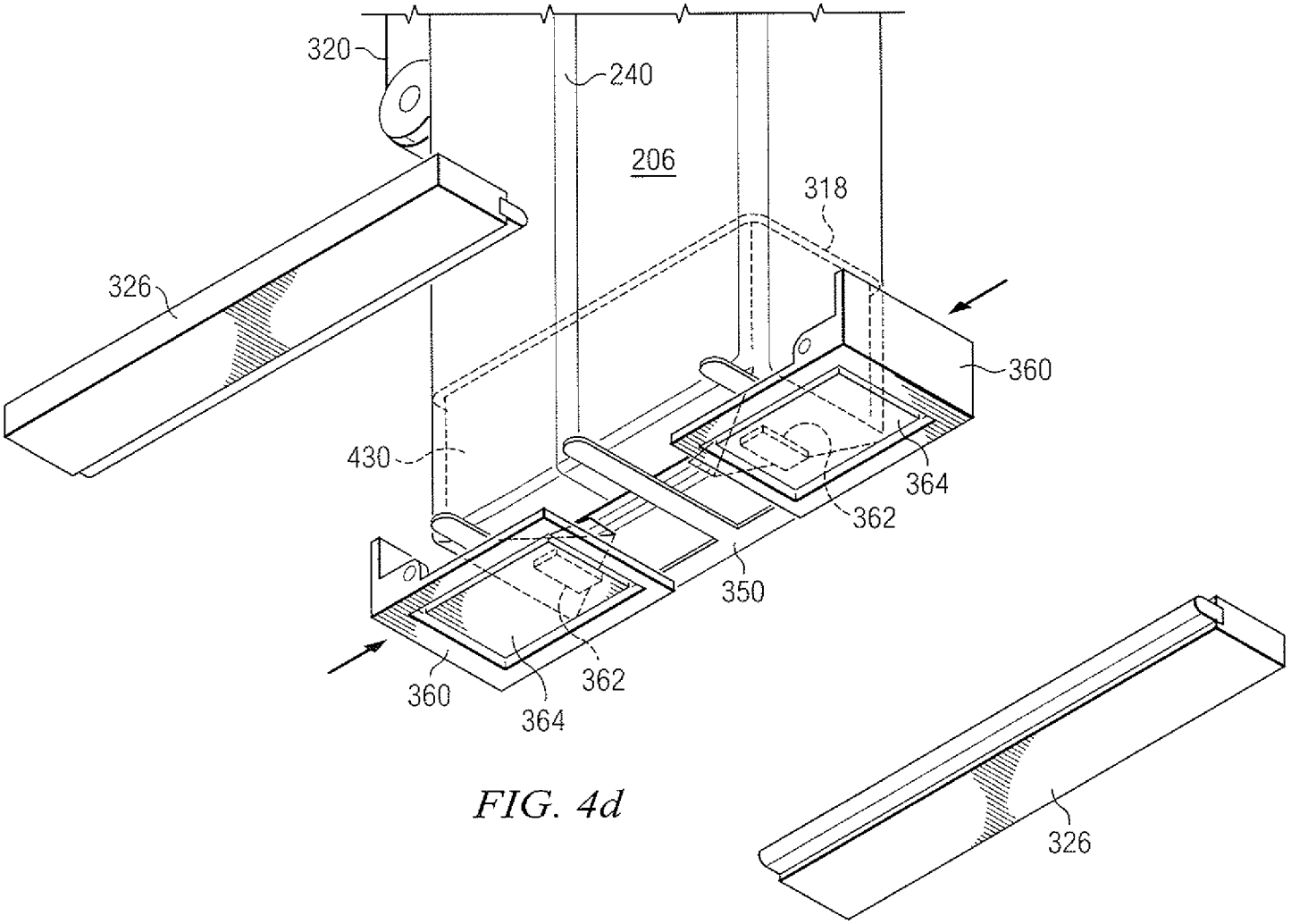

FIG. 4*d* depicts another step of the package formation in accordance with one embodiment of the present invention. The side folding members 360 are positioned in elevation such that the side folding members 360 are below the folding device 350 and above the terminal ends of the flaps 260. As shown in FIGS. 4*d* and 5*d*, a pair of side folding members 360 fold each of said flaps 260 inwardly and beneath the package bottom 250. In one embodiment, the folding device 350 remains beneath the package bottom 250 while the side folding members 360 fold the flaps beneath both the package bottom 250 and the folding device 350. In one embodiment, heat from the folding device 350 and/or the folding members 360 softens the outer film layers of the flaps 260 and the package bottom 250 which helps fuse and seal the flaps 260 to the package bottom 250. In one embodiment, the folding device 350 comprises a fork having at least two fingers. In one embodiment, the folding device 350 comprises a three-fingered fork which advantageously provides an open area for contact between the package bottom 250 and flaps 260 as shown in FIG. 4*d*. In one embodiment, because the bottom transverse seal 230 is still relatively hot from the heated sealing jaws 326, the bottom transverse seal on the flaps 260 is sealed via residual heat to the bottom transverse seal on the package bottom 250 in the open areas between the folding device 350 fingers. In one embodiment, a pedestal 470 (shown in FIG. 4*c*) is disposed below the product delivery tube 318 and inside the extension 430. In one embodiment, the pedestal 470 is substantially flush in elevation with the bottom end of the extension 430 when the extension 430 is in the extended position. The pedestal 470 can be attached to and move with the telescoping extension 430.

Figure 4E:
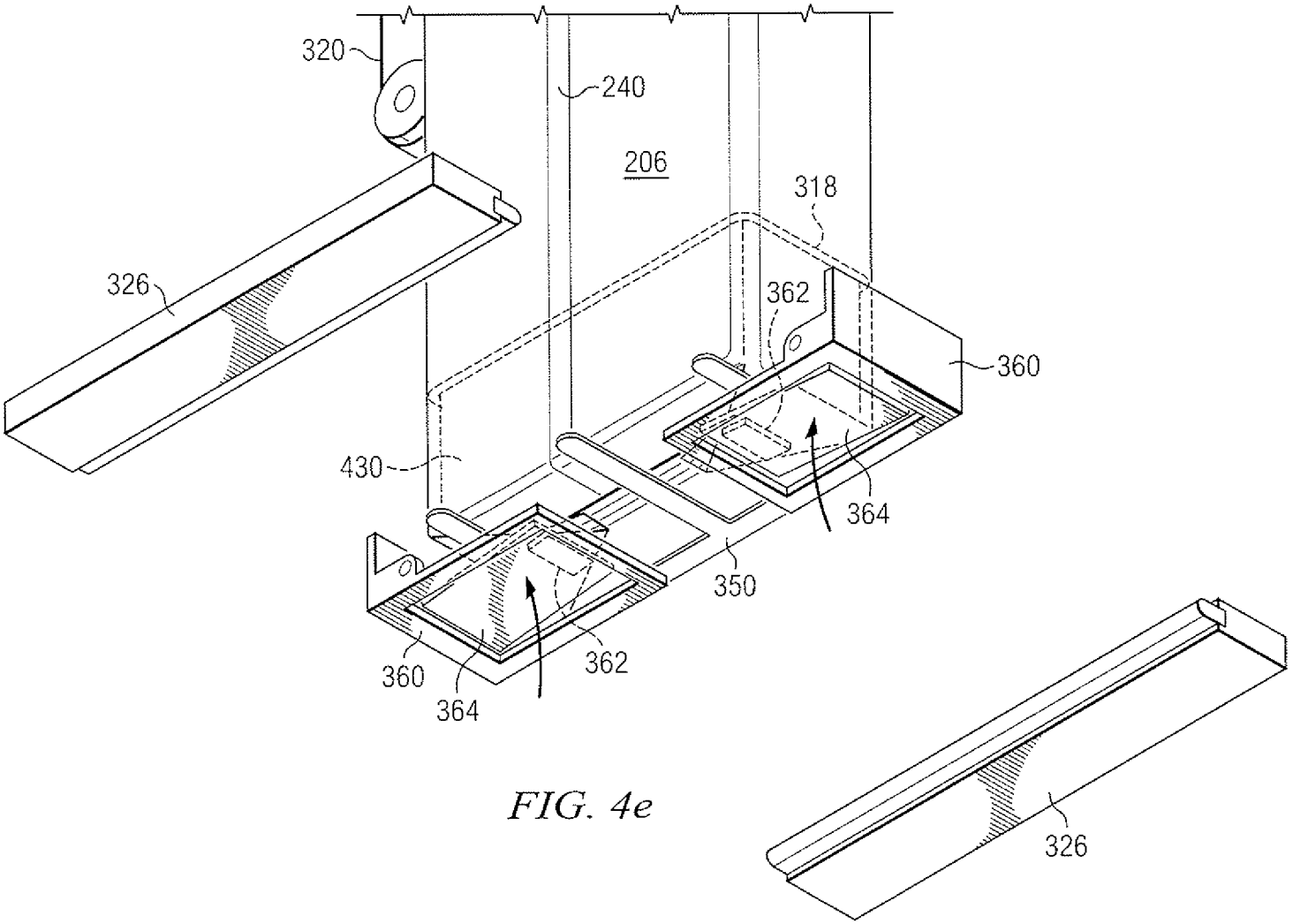

FIG. 4*e* is a bottom perspective view of the next sequential step in accordance with one embodiment of the present invention. As shown in FIG. 4*e*, the side folding member 360 comprises a mount 364 for a pivoting extension 362. After the side folding members 360 have folded the flaps 260 beneath the package bottom 250, a pivoting extension 362 placed on a mount 364 that is flush with each side folding member 360 is moved upward in the direction depicted by the arrows so as to engage the pedestal 470, the pedestal 470 being depicted in FIG. 4*c*. Consequently, referring to FIGS. 4*e* and 5*d*, the pivoting extensions 362 apply pressure between the respective flaps 260 and the package bottom 250. The pedestal 470 (depicted in FIG. 4*c*) holds the package bottom in place 250 such that pressure is applied between the flaps 260 and the package bottom 250. In one embodiment, because the transverse seal 230 has residual heat from the heat sealing jaws, and because of the pressure applied by the pivoting extension 362 against the flaps and the pedestal 470, the portion of the transverse seal from the flaps 260 is sealed to the portion of the transverse seal on the package bottom 250. In one embodiment the side folding members 360 can be heated and in one embodiment the pivoting extension 362 and/or the pedestal 470 is heated to further facilitate the seal between the flaps 260 and the package bottom.

Figure 4F:
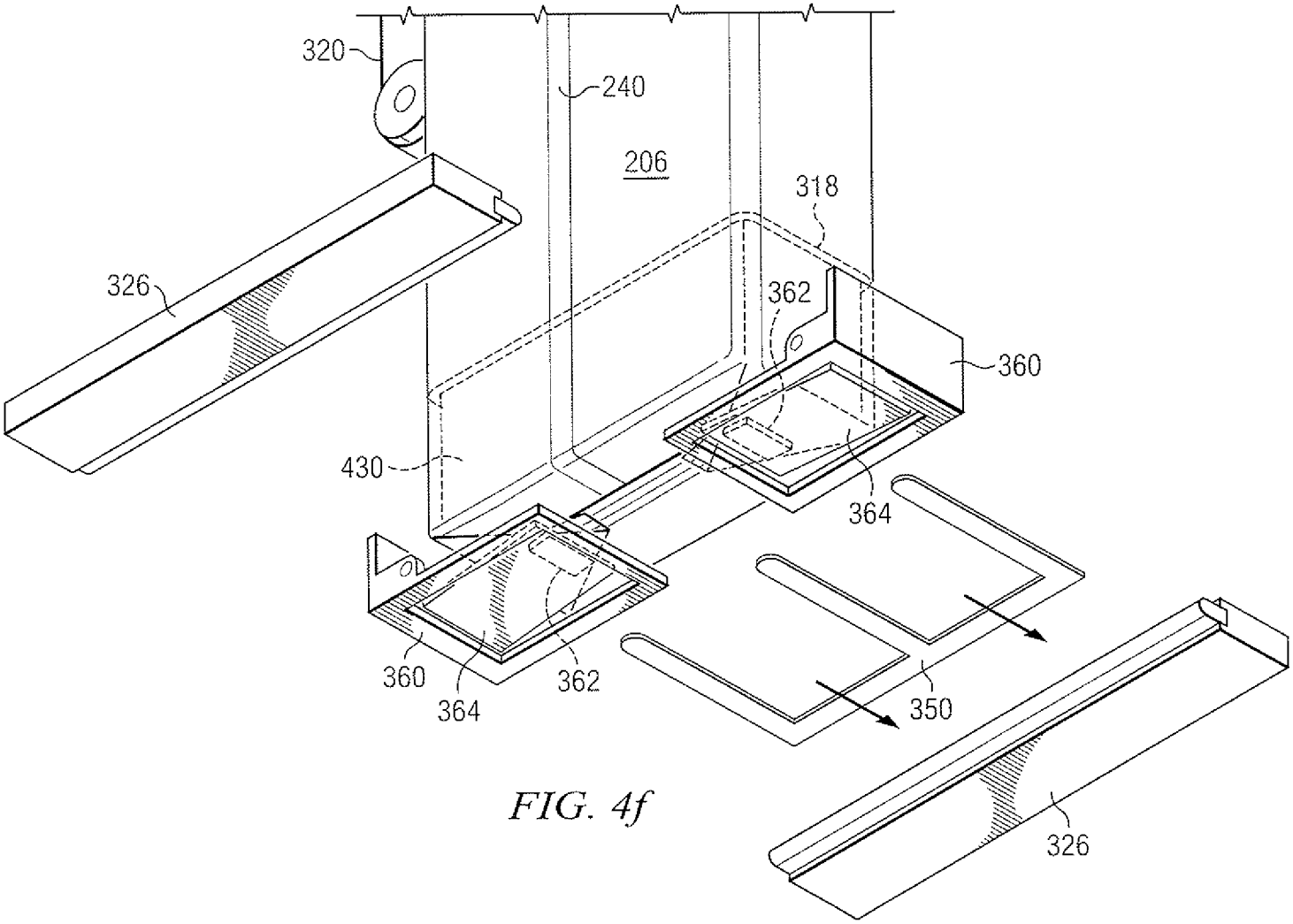

FIG. 4*f* is a bottom perspective view of the next sequential step in accordance with one embodiment of the present invention. Once the flaps 250 have been folded inwardly and optionally sealed to the package bottom 250, the folding device 350 can then be removed from beneath the package bottom 250.

Figure 4G:
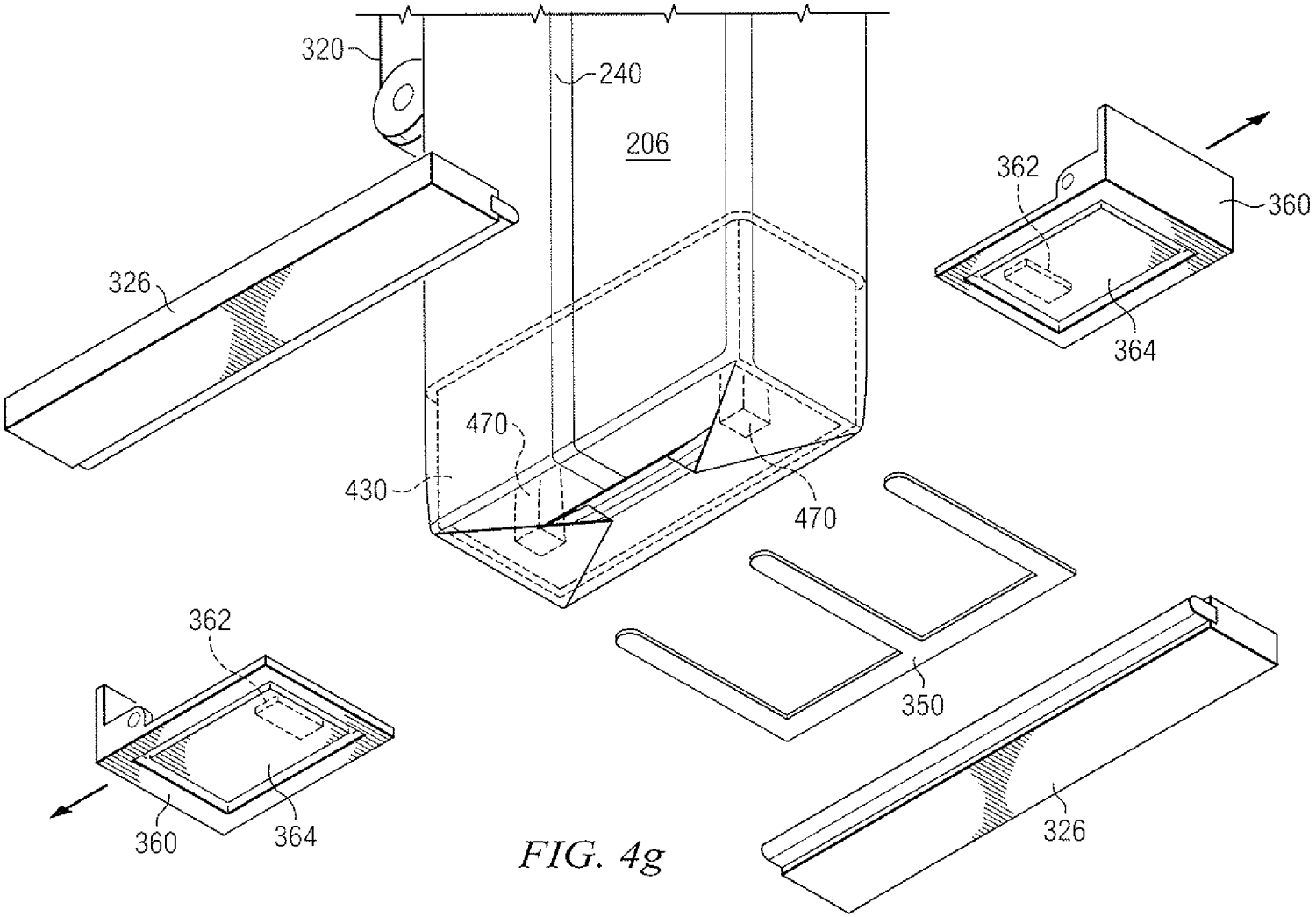

FIG. 4*g* is a bottom perspective view of one step of the present invention. As shown in FIG. 4*f*, the folding members can then be moved outwardly from beneath the package bottom 250. The sheet of film can then be pulled downwardly where the top, transverse seal is made.

FIGS. 5*a*-5*d* are partial simplified rear perspective bottom views depicting the sequential method of how the bottom of the package depicted in FIG. 2*c* is made from the packaging film. The vertical form fill and seal equipment has been omitted. FIG. 5*a* represents the film tube having a backseal 240 and corresponds to the film tube depicted in FIGS. 3*a* and 4*a*. FIG. 5*b* represents the open ended film tube after the bottom transverse seal has been made and corresponds to the film tube depicted in FIGS. 3*b* and 4*b*. FIG. 5*c* depicts the package bottom 250 having a folded bottom transverse seal 230 and an edge 252 that is substantially perpendicular to the rear package face 204. FIG. 5*c* corresponds to the film tube depicted in FIGS. 3*c* and 4*c*. FIG. 5*d* depicts the completed package bottom 250 having a pair of inwardly-folded ears 260 positioned beneath the package bottom and corresponds to the package depicted in FIGS. 3*d* and 4*d*. To make the package of the present invention, a transverse seal is made on an open ended film tube as shown in FIG. 5*b*. Edges 252 are then formed to define a flat package bottom 250. Formation of the edges 252 creates a pair of flaps 260 as shown by FIG. 5*c*. The flaps 260 are then folded inwardly and beneath the package bottom 250 to create side edges 262.

There are several advantages provided by the present invention. First, because the package comprises no gussets, use of a lower gauge flexible film can be used because of the reduction in the number of problem areas where pinhole leaks can occur. The flat bottom pouch of the present invention can be made from film than is less than 180 gauge in thickness. Consequently, the flat bottom pillow pouch can be made with at least 33% less film than is required for the prior art embodiment depicted in FIG. 1*a*-1*d*. In one embodiment, the film used for the present invention consists of a metalized OPP layer having a sealant layer and a reverse printed polymer layer that is laminated with polyethylene or other suitable adhesive layer to the metalized OPP film. Consequently, in one embodiment, the package of the present invention is made from the same film as a pillow package. The invention provides a package and method for making the same from a flexible material without the need for crease lines to be stamped or otherwise impressed into the package film prior to making the package.

An advantage of the present invention is that the top and bottom transverse seals are made without any side gussets. Further, because there are fewer locations for the occurrence of pinholes, the package of the present invention provides more consistent shelf-life. The present invention provides a way to make flat bottom pillow pouches by modifying a standard vertical form fill and seal machine.

While this invention has been particularly shown and described with reference to a preferred embodiment, it will be understood by those skilled in the art that various changes in form and detail may be made therein without departing from the spirit and scope of the invention.

We claim:

1. A method for making a pillow-pouch having a flat bottom, said method comprising the steps of:
   a) forming a first end-seal with a pair of sealing jaws to form an open-ended tube wherein said first end-seal is formed beneath a product-delivery tube having an extension in a retracted position, wherein said extension comprises two flexible flaps, and wherein said flexible flaps flex inwardly to form said retracted position;
   b) providing said extension in an extended position thereby forming a package bottom having a pair of outwardly-extending flaps;
   c) folding said end-seal with a folding device;
   d) folding each of said outwardly-extending flaps inwardly and beneath said package bottom; and
   wherein said providing of said extension into an extended position occurs by actuating a closing mechanism.

2. The method of claim 1 wherein after step a) said closing mechanism is released and said flexible flaps automatically flex back into said extended position of step b).

3. The method of claim 1 wherein said folding of said first end-seal comprises folding with a fork having at least two fingers and an open area therebetween.

4. The method of claim 1 wherein said tube comprises film having a thickness of less than 180 gauge.

5. The method of claim 1 wherein said folding of said first end-seal occurs such that a folded end-seal is created that is substantially 90 degrees from the top end-seal.

6. The method of claim 1 wherein said flaps are sealed to said bottom of said package.

7. The method of claim 6 wherein said flaps are sealed via residual heat imparted by said heat sealing jaws which formed said first-end seal.

8. The method of claim 6 wherein said folding step of d) is performed via a folding member, and wherein said folding member provides heat to seal said flaps to said bottom of said package.

9. The method of claim 1 wherein step d) further comprises the step of applying vertical pressure between each of said flaps and said package bottom.

10. The method of claim 9 wherein said extension further comprises a pedestal located within said extension.

11. The method of claim 9 wherein said folding step of d) is performed via a folding member, wherein said folding member comprises pivoting extensions, and wherein said pivoting extensions apply said vertical pressure.

12. The method of claim 1 wherein during said extended position said flexible flaps are parallel with said product-delivery tube.

13. The method of claim 1 wherein said folding of step a) complises forming said first end-seal without a side gusset.

14. A method for making a pillow-pouch having a flat bottom, said method comprising the steps of:

a) forming a first end-seal with a pair of sealing jaws to form an open-ended tube wherein said first end-seal is formed beneath a product-delivery tube having an extension in a retracted position;

b) providing said extension in an extended position thereby forming a package bottom having a pair of outwardly-extending flaps, wherein said extension in step b) further comprises telescoping an extension from within said product-delivery tube downward;

c) folding said end-seal with a folding device; d) folding each of said flaps inwardly and beneath said package bottom and applying vertical pressure between each of said flaps and said package bottom, wherein said extension further comprises a pedestal located within said extension, wherein said pedestals are utilized to apply said vertical pressure;

e) sealing said flaps to the bottom of said package.

15. The method of claim 14 wherein said folding of step d) is performed by a folding member, wherein said folding member comprises pivoting extensions, and wherein said pivoting extensions apply said vertical pressure against said pedestals.

* * * * *

UNITED STATES PATENT AND TRADEMARK OFFICE

CERTIFICATE OF CORRECTION

PATENT NO. : 9,296,171 B2
APPLICATION NO. : 12/046170
DATED : March 29, 2016
INVENTOR(S) : Patrick Joseph Bierschenk et al.

It is certified that error appears in the above-identified patent and that said Letters Patent is hereby corrected as shown below:

In the Claims

In Claim 13, Column 11 at line 26, please delete “complises” and replace with -- comprises --.

Signed and Sealed this
Thirty-first Day of May, 2016

Michelle K. Lee

Michelle K. Lee
*Director of the United States Patent and Trademark Office*